US007963072B2

(12) United States Patent
Anderson et al.

(10) Patent No.: US 7,963,072 B2
(45) Date of Patent: Jun. 21, 2011

(54) GAZEBO STRUCTURE

(75) Inventors: Torrence Anderson, Overland Park, KS (US); Michael Uffner, Naperville, IL (US); Michael R. Vogler, Oswego, IL (US); Brian C. Donnelly, Naperville, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 144 days.

(21) Appl. No.: 12/250,967

(22) Filed: Oct. 14, 2008

(65) Prior Publication Data

US 2010/0088976 A1 Apr. 15, 2010

(51) Int. Cl.
*E04B 7/00* (2006.01)

(52) U.S. Cl. ..... 52/82; 52/79.1; 52/79.12; 52/79.6; 52/639; D25/56

(58) Field of Classification Search ..... 52/79.1, 52/79.4, 79.6, 82, 90.1, 93.2, 633, 639, 79.12; 135/159, 160; D25/56
See application file for complete search history.

(56) References Cited

U.S. PATENT DOCUMENTS

| | | | | |
|---|---|---|---|---|
| 3,908,329 | A | 9/1975 | Walters | |
| 4,173,855 | A | 11/1979 | Raptoplous | |
| 4,275,534 | A * | 6/1981 | Porter | 52/82 |
| 4,357,118 | A | 11/1982 | Murray | |
| 4,426,814 | A * | 1/1984 | Stuhmer | 52/82 |
| 4,739,594 | A * | 4/1988 | Langford et al. | 52/82 |
| D296,593 | S * | 7/1988 | Alpert | D25/1 |
| D305,070 | S | 12/1989 | Dalton | |
| D306,761 | S | 3/1990 | Caraco | |
| 5,197,241 | A | 3/1993 | Romeo et al. | |
| 5,236,273 | A | 8/1993 | Gilb | |
| 5,555,681 | A | 9/1996 | Cawthon | |
| D402,376 | S | 12/1998 | St. Gelais et al. | |
| 5,867,961 | A | 2/1999 | Castano | |
| D411,309 | S | 6/1999 | St. Gelais et al. | |
| 5,979,119 | A | 11/1999 | Trafton | |
| D434,156 | S | 11/2000 | McDonald | |
| 6,295,768 | B1 | 10/2001 | Romero | |
| 6,349,511 | B1 | 2/2002 | McAlpin et al. | |
| D458,689 | S | 6/2002 | Wang | |
| 6,460,309 | B1 * | 10/2002 | Schneider | 52/837 |
| 6,530,188 | B2 | 3/2003 | Loyd | |
| D473,660 | S | 4/2003 | Wang | |
| D482,130 | S | 11/2003 | Wu | |

(Continued)

FOREIGN PATENT DOCUMENTS

GB 2177436 A * 1/1987

*Primary Examiner* — Brian E Glessner
*Assistant Examiner* — James J Buckle, Jr.
(74) *Attorney, Agent, or Firm* — McHale & Slavin, P.A.

(57) ABSTRACT

The present invention includes a system or kit of injection molded panels and other components having integrated connectors which combine together to form an enclosure, preferably in the form of a gazebo. The support posts, roof rafters, roof supports, roof panels and walls are formed of injection molded plastic to interlock with one another without the need for separate I-beam connectors. The system incorporates a minimum number of components to construct a gazebo type enclosure by integrally forming connectors in to the injection molded components and panels. This minimizes the need for separate extruded or molded connectors to assemble the enclosure. The symmetry of the support posts, roof rafters, roof supports, roof panels and other components also minimizes the shapes of the components and simplifies construction of the gazebo.

18 Claims, 25 Drawing Sheets

U.S. PATENT DOCUMENTS

| | | | | |
|---|---|---|---|---|
| D482,798 | S | 11/2003 | Wang | |
| D483,128 | S | 12/2003 | Wang | |
| D483,498 | S | 12/2003 | Wang | |
| D483,878 | S | 12/2003 | Coderre | |
| 6,745,521 | B1 | 6/2004 | Klemming | |
| D500,369 | S | 12/2004 | Wang | |
| D500,858 | S | 1/2005 | Wang | |
| D501,259 | S | 1/2005 | Wang | |
| 6,843,026 | B2 * | 1/2005 | Hoehn | 52/82 |
| D506,262 | S | 6/2005 | Wang | |
| D522,146 | S | 5/2006 | Merritt | |
| D532,116 | S | 11/2006 | Merritt | |
| 7,168,439 | B2 | 1/2007 | Patel et al. | |
| 7,178,539 | B2 | 2/2007 | Patel et al. | |
| 7,207,344 | B2 * | 4/2007 | Wu | 135/158 |
| 7,628,164 | B2 * | 12/2009 | Ma | 135/121 |
| 2001/0042347 | A1 * | 11/2001 | Kasinger et al. | 52/79.4 |
| 2003/0024175 | A1 * | 2/2003 | Jones et al. | 52/90.1 |
| 2003/0159369 | A1 * | 8/2003 | Hoehn | 52/82 |
| 2005/0235580 | A1 * | 10/2005 | Golden | 52/79.1 |
| 2007/0204551 | A1 * | 9/2007 | Izardel | 52/639 |
| 2007/0214733 | A1 * | 9/2007 | Braun | 52/79.6 |
| 2007/0245639 | A1 * | 10/2007 | Owens | 52/82 |
| 2007/0281858 | A1 * | 12/2007 | Wahlberg | 504/119 |

* cited by examiner

GAZEBO STRUCTURE

FIELD OF THE INVENTION

The present invention relates to prefabricated, multi-sided building and construction system. In particular it relates to a prefabricated gazebo and a construction system which utilizes lightweight framing components and a unique roof support and roof which results in the construction of the gazebo.

BACKGROUND OF THE INVENTION

Gazebos and other multi-sided buildings are well known in the prior art. Gazebos have historically been multi-sided buildings usually constructed in a park form wood or similar materials. Recently Gazebos have found popularity in areas of multi-family residences or in single family homes on larger pieces of land.

DESCRIPTION OF THE PRIOR ART

U.S. Pat. No. 4,173,855 discloses a prefabricated building or gazebo having an octagonal configuration. The structure includes a structural support system, a floor system carried by the support system above the level of the ground, and a roof system supported solely by the support system. The floor and roof systems are provided with collars, each with at least three sides, which are spaced apart and are located on the central vertical axis of the structure. The structural support system includes at least three vertical support columns with each column being spaced an equal distance from the central axis of the structure and also equal distances form adjacent columns. The roof system includes rafters of equal length one for each side of the roof collar and corresponding support column. However, this structure does not offer an easily assembled gazebo constructed of light weight materials, such as plastic, which can be readily assembled by a single individual. It also does not offer a basic gazebo structure with different embodiments.

U.S. Pat. No. 3,908,329 discloses a polygonal building which has a perimeter wall made from a plurality of initially roughly plumbed rectangular wall sections arranged in end-to-end but spaced apart relation to each other. Roof rafter extend from a common point, approximately centrally of the building, down to and between the upper ends of adjacent wall sections. A perimeter cable is threaded through the all of the wall sections and the roof rafters. Tightening of the cable plumbs the wall sections and centers the roof rafters.

U.S. Pat. No. 6,349,511 discloses a gazebo which is fabricated from lightweight aluminum framing components. The preferred structure has eight sides. Each side includes a pair of vertical posts, a pair of header members, a rail and foot member, columns disposed between the rail and foot member and the pair of header members, and an insulated composite roof panel. As each side unit is attached by self mating beam and vertical post members to an adjacent side unit, the gazebo structure is formed. The gazebo can be provided with screening on the vertical posts and shingles on the roof.

SUMMARY OF THE INVENTION

The present invention includes a system or kit of injection molded panels and other components having integrated connectors which combine together to form an enclosure, preferably in the form of a gazebo. The support posts, roof rafters, roof supports, roof panels and walls are formed of injection molded plastic to interlock with one another without the need for separate I-beam connectors. The system incorporates a minimum number of components to construct a gazebo type enclosure by integrally forming connectors in to the injection molded components and panels. This minimizes the need for separate extruded or molded connectors to assemble the enclosure. The symmetry of the support posts, roof rafters, roof supports, roof panels and other components also minimizes the shapes of the components and simplifies construction of the gazebo. The heavy duty interlocking construction of the support posts, roof rafters, roof supports, roof panels and other components create a structural frame which permits construction of larger gazebos. Injection molding of the support posts allows them to be formed to a sufficient length to provide a gazebo with adequate height for all intended purposes, including the provision of overhead fans. This eliminates the need for a plurality of support posts to be stacked one above the other to achieve the heights desired. Injection molding also allows the roof panels to be formed with integral cross-bracing, ribs and gussets for increased rigidity when compared to blow molded or extruded panels.

In one embodiment, the gazebo system or kit utilizes interlocking support posts, roof rafters and roof supports to create a structural frame. Three types of support structure construction are integrated into the structural frame. The first is utilized for the support posts, the second is utilized for the roof rafters and the third is utilized for the roof supports. The support posts are constructed to cooperate, via integrally formed connectors, with the roof rafters and other members that permit the support posts to be secured to a base or other means to secure the support posts to the ground. The roof rafters are constructed to cooperate, via integrally formed connectors, with the roof supports to form a support structure which will support the roof panels. The roof supports also include integrally formed connectors which permit the roof supports to cooperate with the roof rafters to form a support structure which will support the roof panels. The structural frame may include provisions for standard electrical current hookups. The roof support may also include connectors to permit the use of additional components such as fans or lighting components.

Accordingly, it is an objective of the instant invention to provide a system or kit which utilizes plastic frame and panel members having integral connectors to create a gazebo type structure or enclosure of varying dimensions using common components.

It is a further objective of the instant invention to provide a system or kit wherein the structural components include integrated connectors which accommodate injection molding plastic formation of the components for increased structural integrity.

It is yet another objective of the instant invention system or kit which utilizes roof rafters and roof supports having interlocking bosses and apertures to increase rigidity and prevent bowing of the rafters and supports.

It is a still further objective of the invention to provide structural roof panel members including integrated connectors, cross-bracing and gussets to increase rigidity and prevent bowing of the roof panels.

It is still yet another objective of the instant invention to provide a system or kit which reduces the number of components required to assemble a gazebo and simplifies construction of a gazebo.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
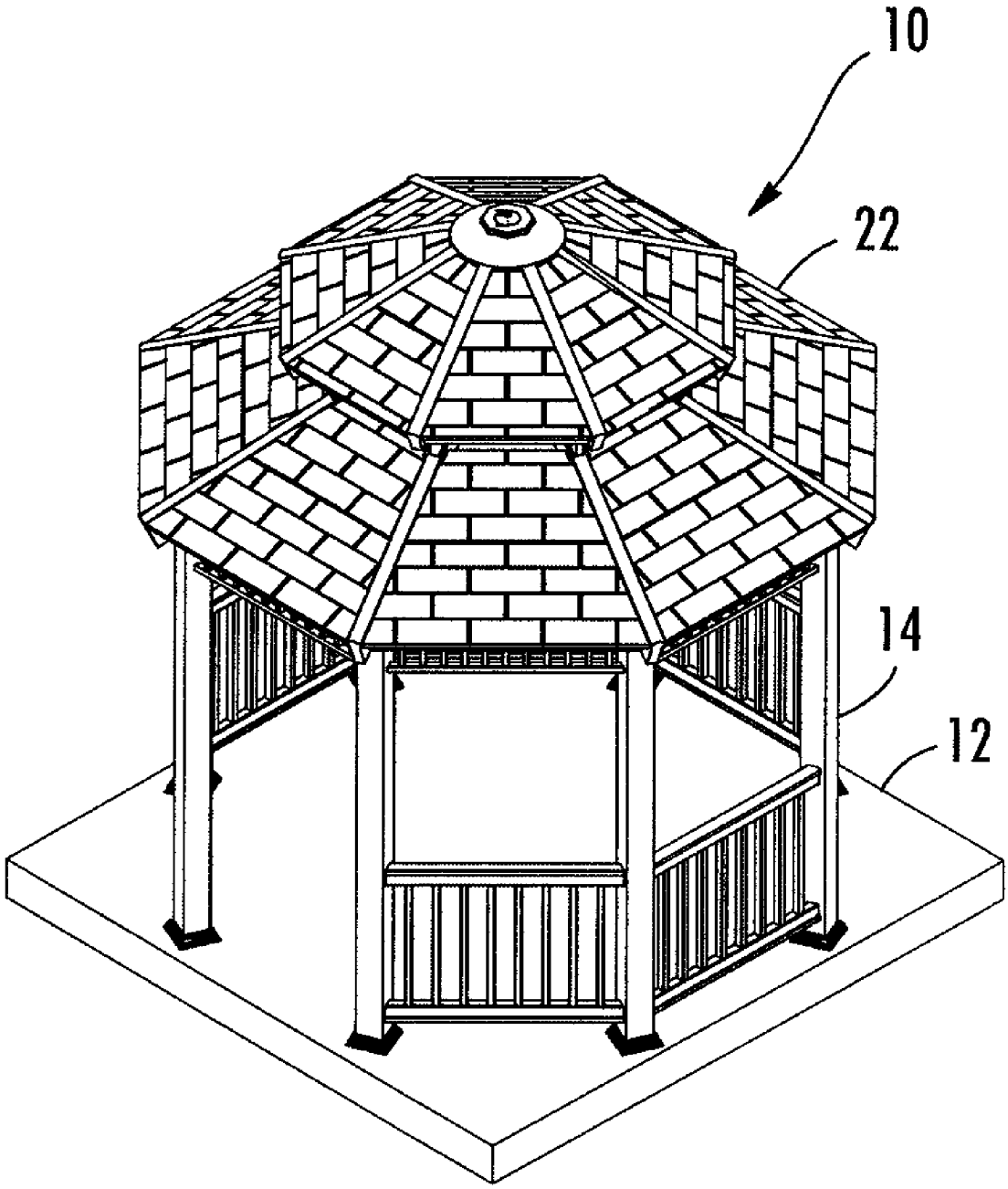
FIG. 1 is a perspective view of a preferred embodiment of the gazebo of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIG. 1 illustrates a perspective view of a gazebo type structure, generally referenced as 10, constructed in accordance with a preferred embodiment of the present invention. In the preferred embodiment, the components of the gazebo, including the roof, are formed of not limited to a suitable plastic such as polystyrene, polypropylene or polyethylene, through the process of injection molding. The gazebo is set upon a base or platform 12. The base or platform may be included as an element of the gazebo, but preferably it is not. The base can be formed as a poured concrete slab or platform, as a wooden deck, or as a plurality of interconnected components such as bricks or pavers. One of the requirements of the base or platform 12 is that it is capable of properly supporting and securing the support posts 14 and attached gazebo structure, including the roof assembly 22. The base or platform must also be capable of providing proper support for individuals and other objects enclosed within the gazebo.

Figure 2A:
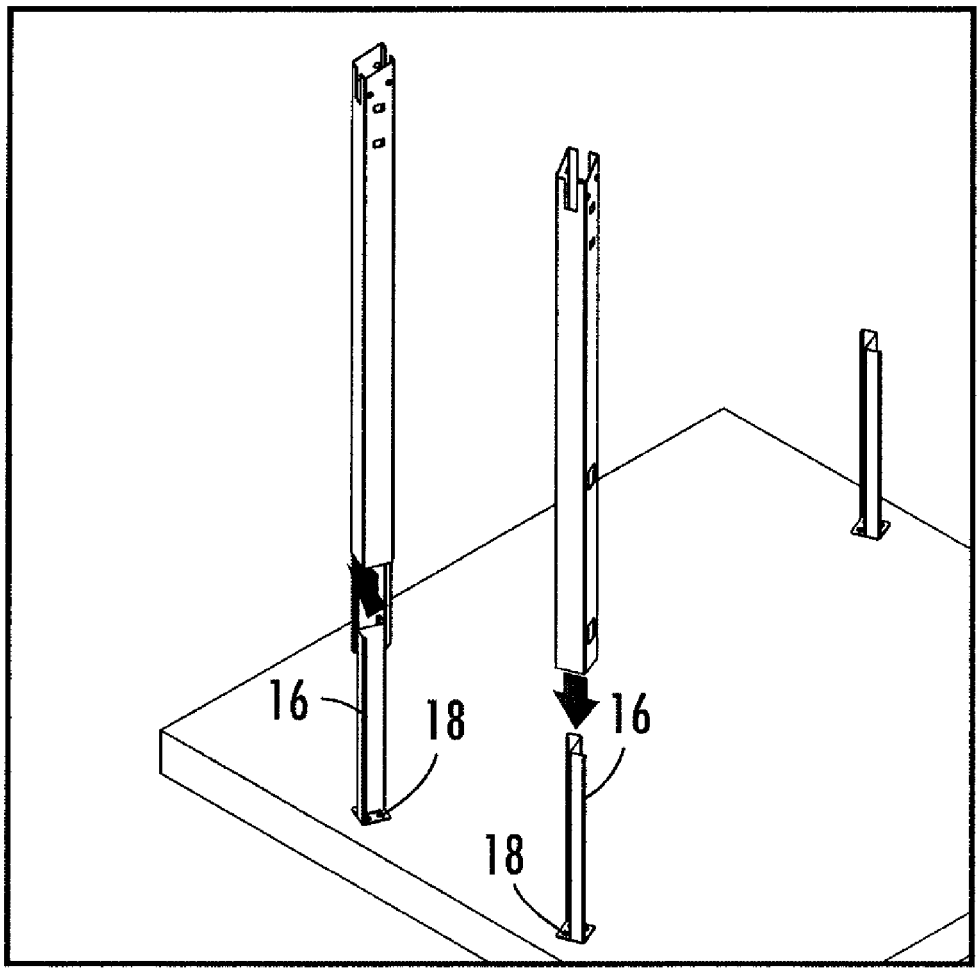
FIG. 2A is a view of a base onto which the gazebo is secured using a plurality of support posts.
Figure 2B:
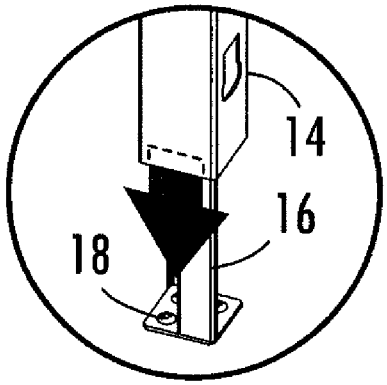
FIG. 2B is a detailed view of the attachment of the support posts to the base.
Figure 3A:
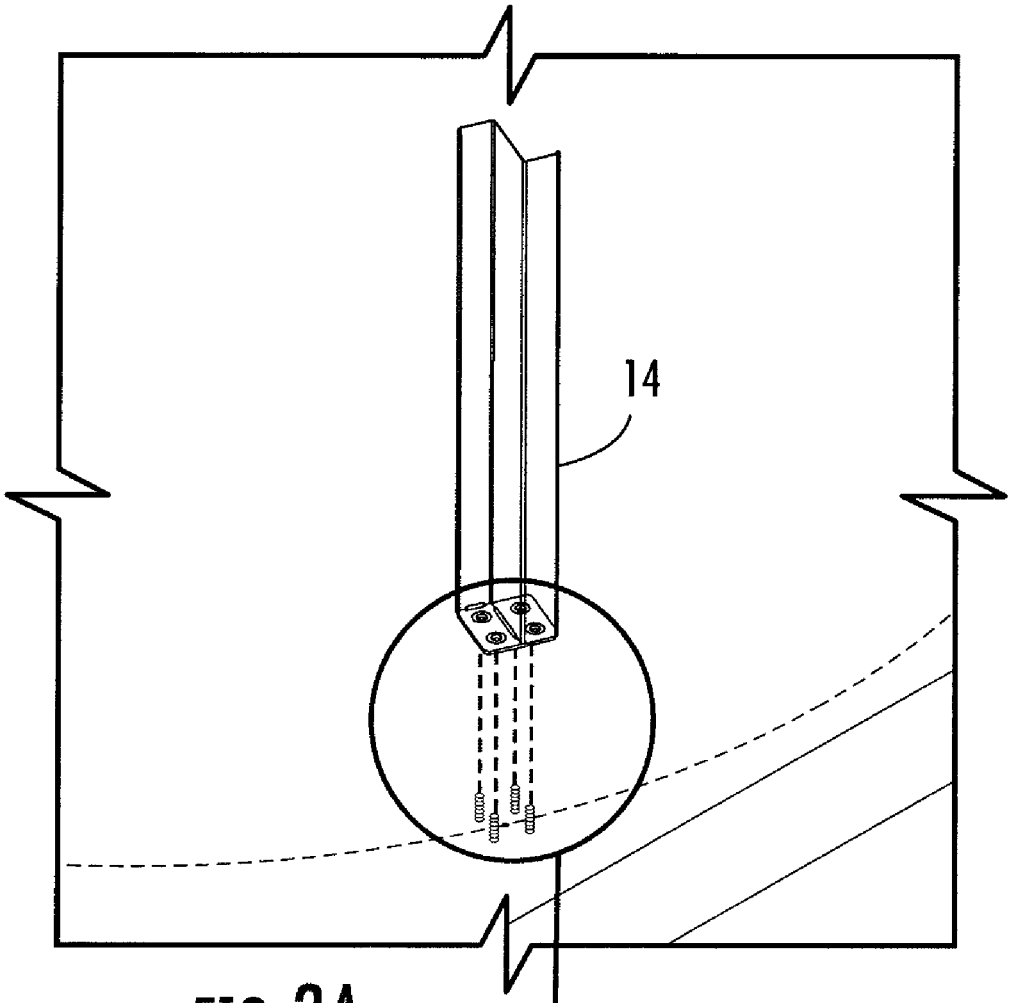
FIG. 3A is another view of a base and support posts similar to FIG. 2A.
Figure 3B:
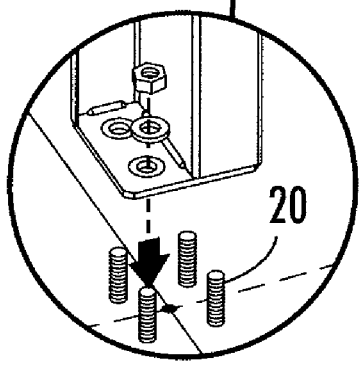
FIG. 3B is a detailed view of the attachment of the support posts to the base similar to FIG. 2B.

Referring to FIGS. 2A and 2B the support posts 14 are secured to the base 12 utilizing attachment posts 16. These attachment posts are preferable made from steel. However, other materials could be used providing these materials permit the support posts 14 to be properly secured to base 12. The base of the attachment posts are provided with apertures 18, as shown in FIG. 2B. The attachment posts 16 are preferably secured to the base in the manner illustrated in FIG. 3B. A plurality of fasteners 20 are secured in base 12. The posts are secured to the fasteners using nuts and washers. The fasteners 20 could be set into a poured concrete slab prior to its drying. They could also be set into holes drilled into a dried concrete slab and secured with expansion anchors. When a wooden deck is employed as the base, the fasteners can be bolts or screws. Depending on the type of base that is used, appropriate fasteners are utilized. FIG. 3A illustrates that a number of support posts, in this case 8, are secured to base 12. The support posts 14 are preferably secured in a circular pattern.

The support posts 14 are next secured to the attachment posts 16 by use of fasteners. Preferably a support post 14 is placed over an attachment post 16 and set onto base 12. After the support post 14 is in place it is secured to the attachment post 16 with fasteners. The fasteners are inserted into apertures which are drilled into posts 14 and 16.

Figure 4A:
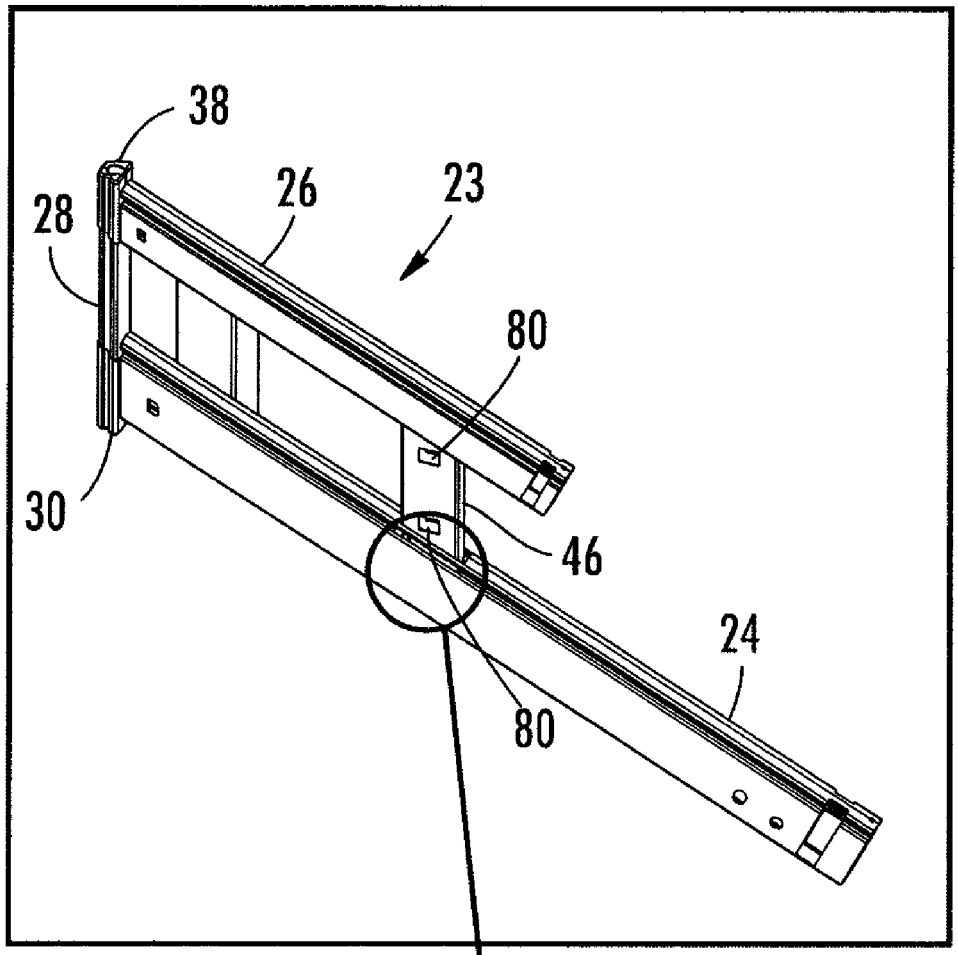
FIG. 4A is a perspective view of a roof support member.
Figure 4B:
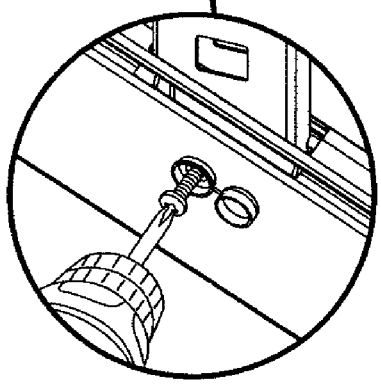
FIG. 4B is a detailed view of the attachment of an outer roof support the roof rafters.
Figure 5:
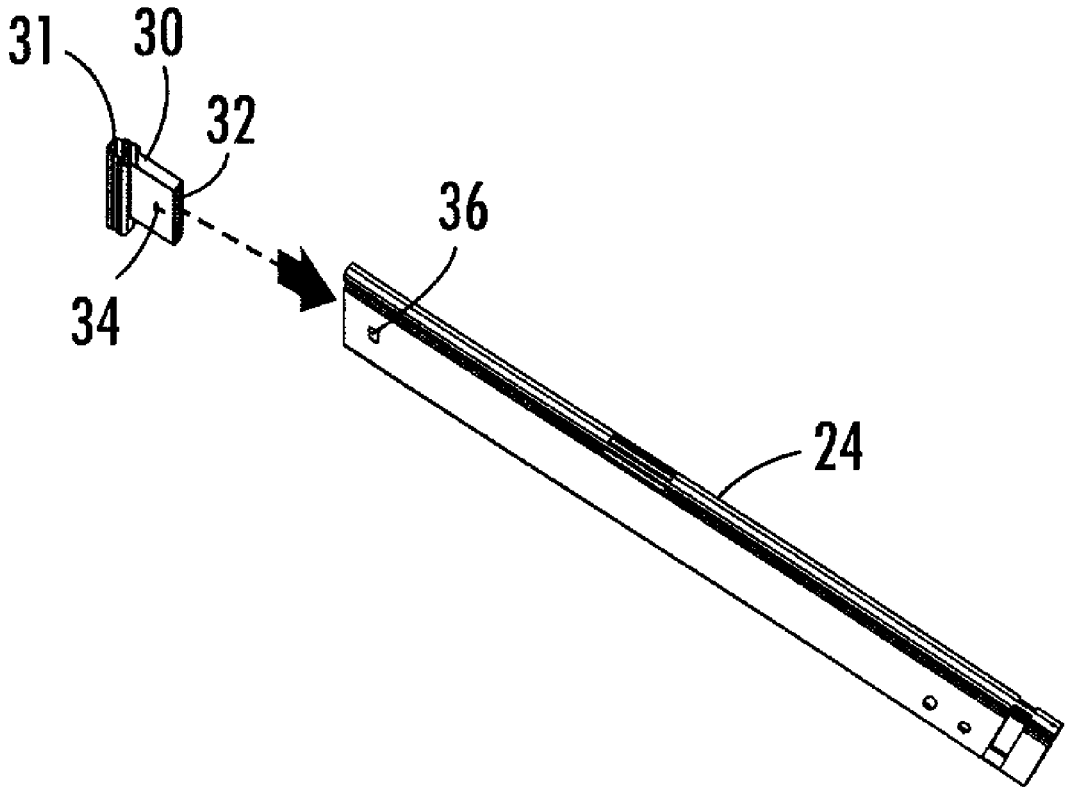
FIG. 5 is a view of a lower roof rafter and a socket secured to an end.
Figure 6:
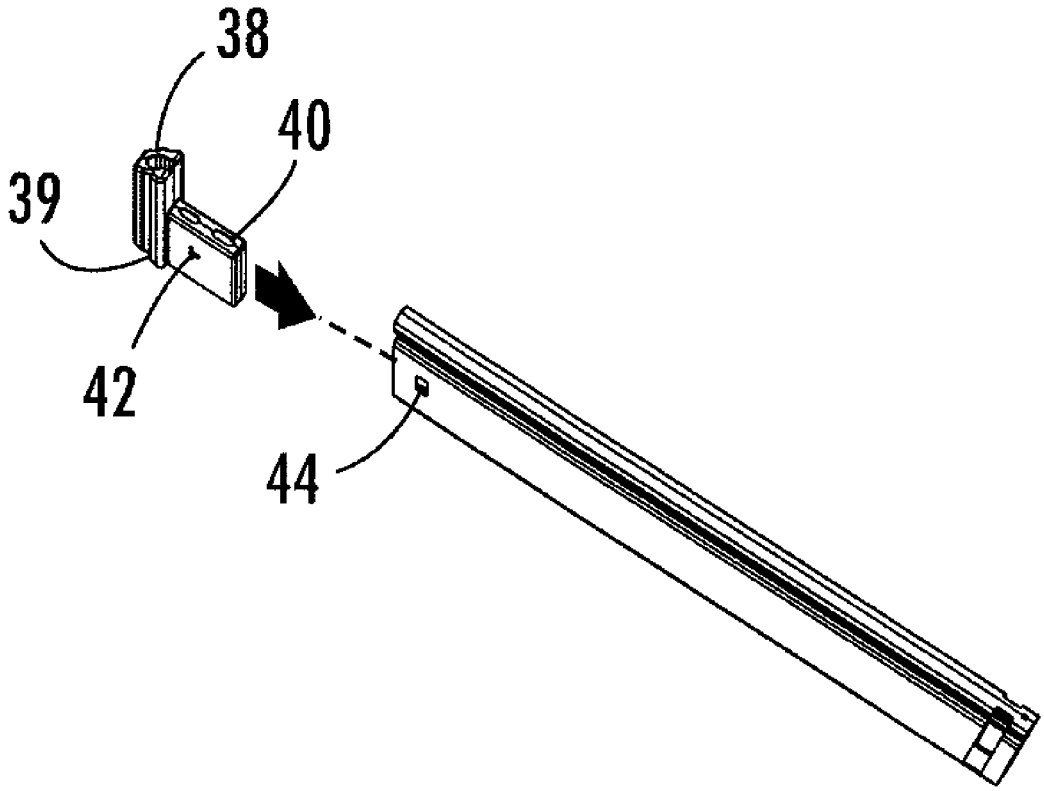
FIG. 6 is a view of the ramp lock connection between the sockets and the roof rafters.

A roof for the disclosed embodiment of the gazebo includes an upper roof and a lower roof. While a multi-layered is disclosed, a roof comprising a single layer is an alternative. The roof 22 comprises a plurality of roof support members and roof panels. These roof support members and roof panels are readily assembled from a plurality of various components as will be described hereinafter. FIGS. 4-6 illustrate an assembly of one of the roof support members 23. A roof support member 23 is formed from roof rafters and roof supports. A lower roof rafter 24 is positioned below and aligned with an upper roof rafter 26. Roof rafters 24 and 26 are secured together, at one end thereof, by an inner roof support or segment 28. A segment, receptacle or socket 30 is attached to one end of rafter 24, as illustrated in FIG. 5. Receptacle 30 is provided with a connection member 32 along one side. The connection member 32 is formed with a ramp lock 34 on at least one surface thereof. The ramp lock 34 is positioned so that when the connection member is placed into the interior of roof rafter 24, the ramp lock 34 will engage aperture 36, located on a side of roof rafter 24, for interlocking engagement therewith. The interlocking engagement between ramp lock 34 and aperture 36 secures connection member 32 of the receptacle 30 to the lower roof rafter 24. The receptacle 30 further includes a socket 31 which is sized so that an end of inner roof support 28 will fit snugly therein. Another segment, receptacle or socket 38 is attached to one end of an upper roof rafter 26, as illustrated in FIGS. 4 and 6. Receptacle 38 is provided with a connection member 40 along one side thereof. The connection member 40 is formed with a ramp lock 42 on at least one surface thereof. The ramp lock 42 is positioned on the connection member so that when the connection member is placed in the interior of roof rafter 26, the ramp lock 42 will engage aperture 44, located on a side of upper roof rafter 26, for interlocking engagement therewith. The interlocking engagement between ramp lock 42 and aperture 44 secures receptacle to the upper rafter 26. The receptacle feather includes a socket 39, opening toward the bottom of the socket. The socket 39 is sized so that an upper end of inner roof support 28 will fit snugly therein.

Figure 7B:
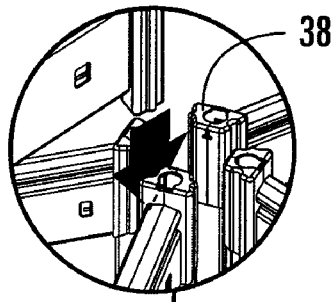
FIG. 7B is a detailed view of the arrangement of the upper receptacles.
Figure 7A:
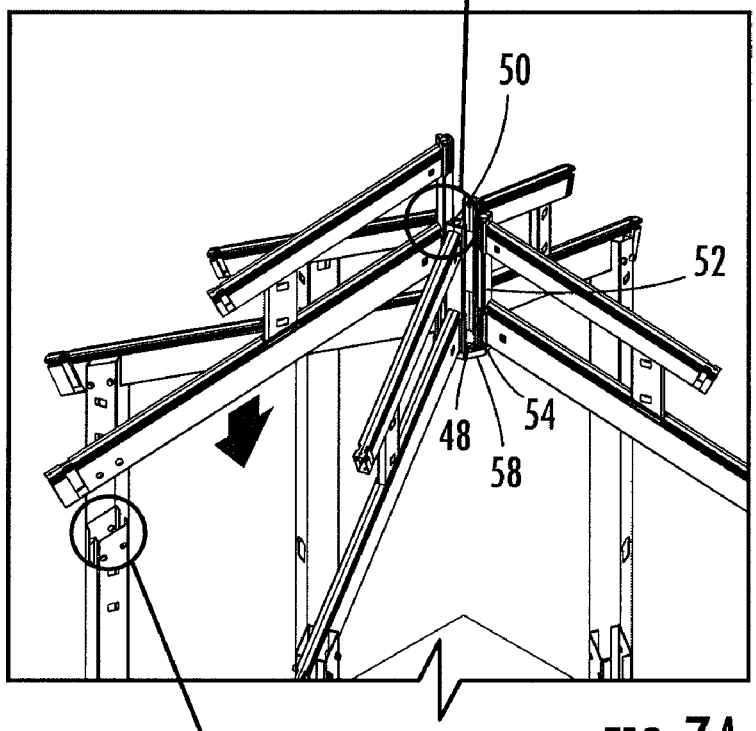
FIG. 7A is a view of the attachment of the roof support members to the support posts.
Figure 8A:
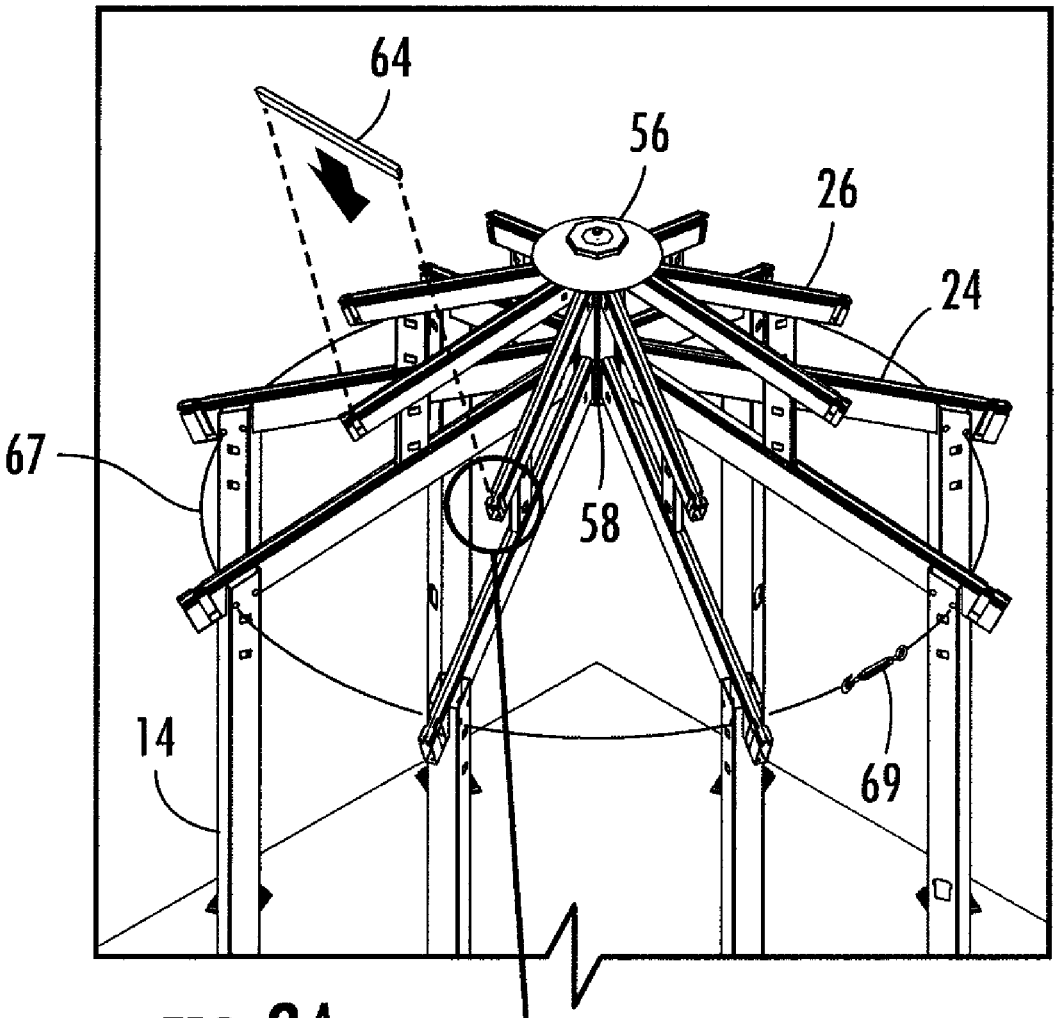
FIG. 8A is a view of all of the roof support members secured together.

An outer roof support 46 is secured between and holds roof rafters 24 and 26 together, as illustrated in FIG. 4. A lower end of outer roof support 46 is placed into the interior of lower roof rafter 24 through a slot on an upper edge of lower roof rafter 24. The lower end of the outer roof support is preferably formed at an angle with respect to the edges of the outer roof support. This angle corresponds to the angle or pitch of the lower roof rafter 24. After the support 46 has been inserted into lower roof rafter 24 it is secured therein with fasteners. An upper end of roof support 46 is placed into the interior of upper roof rafter 26 through a slot on a lower edge of upper roof rafter 26. After the support 46 has been inserted into rafter 26 it is secured therein with fasteners. A plurality of roof support members 23 are secured together to form a center hub 48, as illustrated in FIGS. 7A and 8A. The center hub 48 includes an upper section 50, a middle section 52 and a lower section 54. The upper section 50 comprises a plurality of receptacles 38 secured together as illustrated in FIG. 7A. The receptacles 38 are formed with complementary sides, as illustrated in FIG. 7B. These complementary sides enable the receptacles 38 to be secured together to form the upper section 50 of the central hub 48. A cap 56 (FIG. 8A) secures a plurality of receptacles 38 together thereby form the upper section 50. The middle section of the center hub comprises a plurality of inner roof supports 28 secured around a central point. The upper ends of the inner roof supports are positioned within receptacles 38 and the lower ends of the inner roof supports are positioned within receptacles 30. The lower section of the center hub comprises a plurality of receptacles 30 secured together. The receptacles 30 are formed with complementary sides, similar to sides of receptacles 38. These complementary sides enable the receptacles 30 to be secured together to form the lower section 54 of the central hub 48. A cap 58 (FIG. 7A) is secured to the bottom portions of the receptacles 30 and provides assistance in holding the plurality of receptacles 30 together.

Figure 7C:
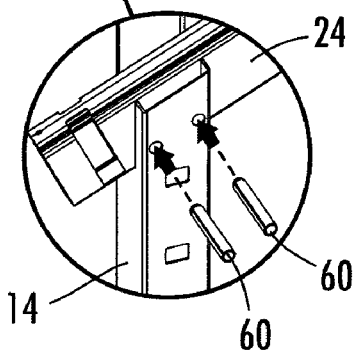
FIG. 7C is a detailed view of the attachment of a roof rafter to a support post.
Figure 8B:
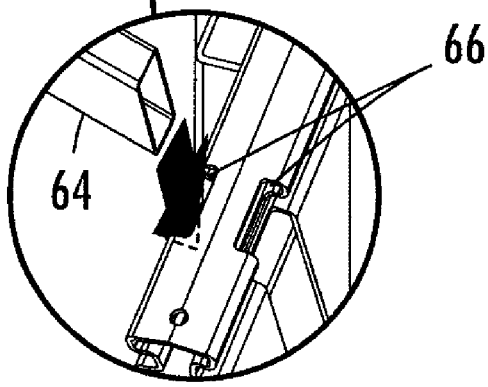
FIG. 8B is a detailed view of a fascia board secured to an upper roof rafter.
Figure 9B:
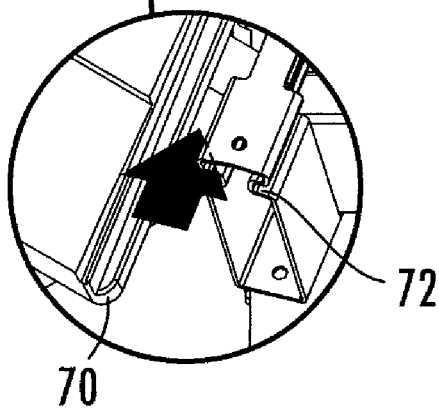
FIG. 9B is a detailed view of the attachment of an upper roof panel to an upper roof rafter.
Figure 10A:
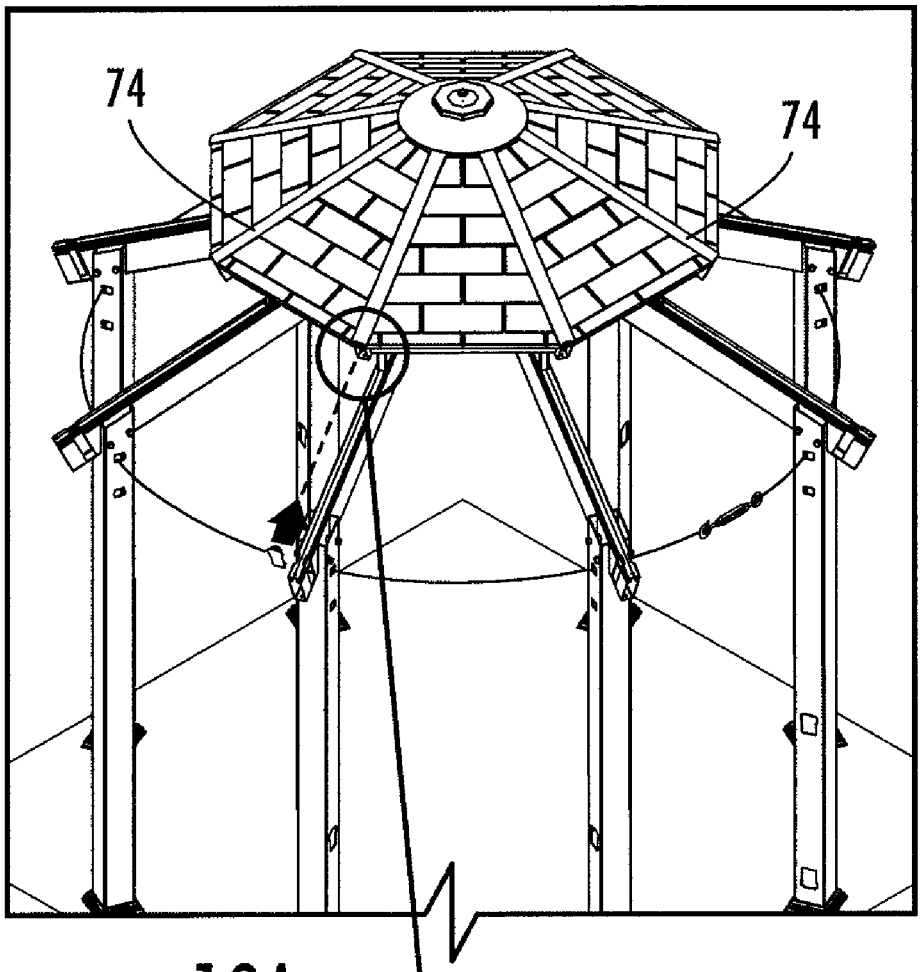
FIG. 10A is a view of all of the upper roof panels secured to the upper roof rafters.
Figure 10B:
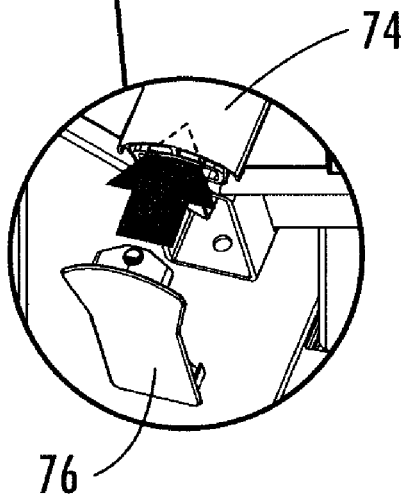
FIG. 10B is a detailed view of an end cap on an upper roof rafter.

The outer portions of the lower roof rafters 24 are secured to the upper portions of support posts 14 in a manner illustrated in FIG. 7C. A slot is provided in the top of support post 14 and an end portion of a lower roof rafter 24 is placed into the slot. A plurality of fasteners 60 secure each of the support posts 14 to each roof rafter 24. A plurality of roof rafter assemblies are attached to each of the support posts and secured together by caps 56 and 58 to form a support for the roofs (FIG. 8A). A wire 62 encircles the support posts 14. It can be secured to an outer surface of support posts 14 or passed through a portion of the support posts 14. The wire helps hold the upper portion of the gazebo together and oppose any radial outwardly forces Referring to FIGS. 8A and 8B upper roof fascia boards 64 are secured between the outer ends of upper roof rafters 26. The ends of the upper roof fascia boards are placed into slots 66 formed in an outer portion of the upper roof rafters 26, FIG. 8B. In the embodiment illustrated there are 8 fascia boards. The upper fascia boards 64 can also be secured to the upper roof rafters 26 by fasteners, friction or other securing means. The upper roof fascia boards 64 provide stability to the upper roof rafters so that they will maintain a substantially fixed position relative to each other. This positioning of the upper roof rafters enables upper roof panels 68 to be secured between the upper roof rafters. The upper roof panels are provided with a flange 70 which extends along each longitudinal side. The flange 70 is designed to be placed into a slot 72 which extends longitudinally along both sides of an upper portion of upper roof rafter 26, FIG. 9B. The upper roof panels are slid up along the upper roof rafters into their final position wherein the narrow portion of the upper roof panel is positioned below cap 56. Once the roof panels are in their final position they are also secured to the upper roof fascia boards 64 by fasteners or other securing means. Trim elements 74 are secured over the top portion of each of the upper roof raters, as illustrated in FIG. 10A. A cap 76 is placed over each outer open end of each of the upper roof rafters 26 and secured in place as illustrated in FIG. 10B.

Figure 9A:
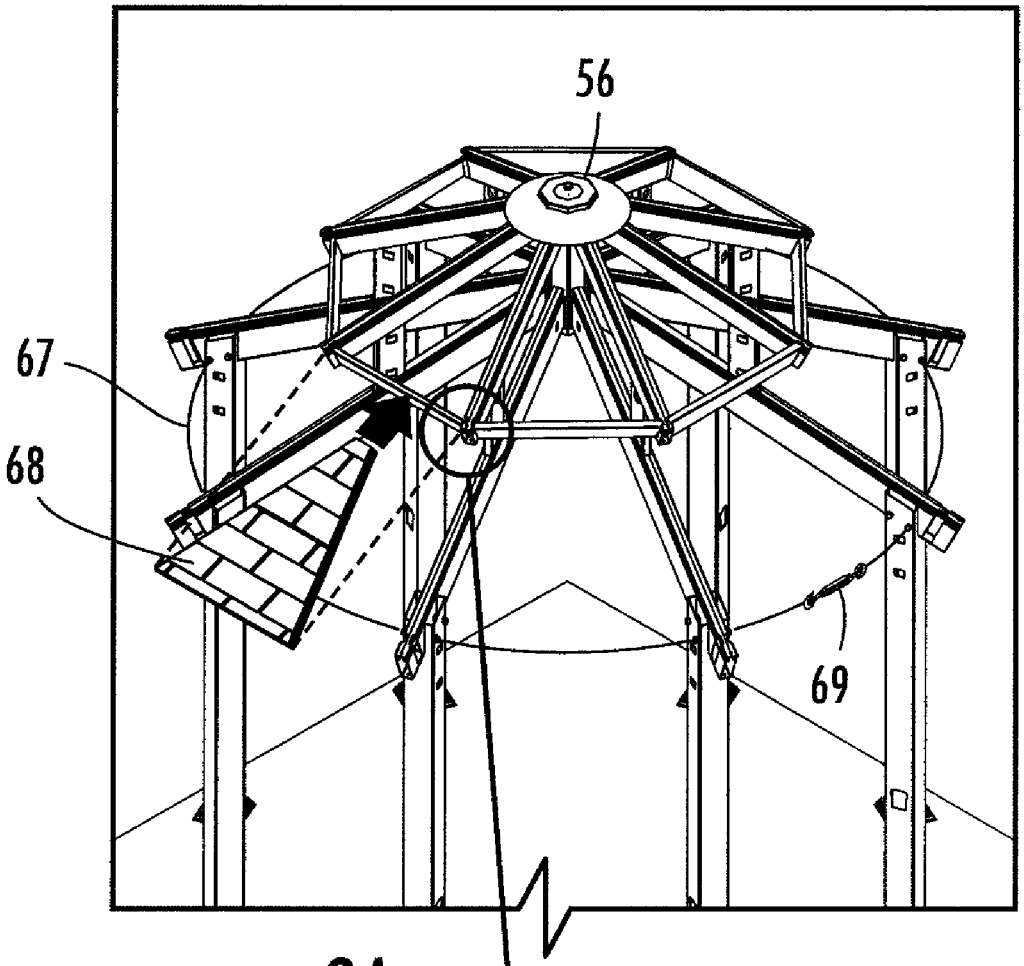
FIG. 9A is a view of the attachment of an upper roof panel to the upper roof rafters.

A wire or cable 67 extends through each of the support posts 14 and lower roof rafters 24, as illustrated in FIGS. 8A and 9A. The wire or cable is substantially circular and one end of the wire or cable is secured to the other end of the wire or cable by a turnbuckle 69 or similar device (FIG. 9A). The wire or cable helps to secure and hold the supports posts and roof rafters together. Other means could be used in place of the wire or cable as long as it performed the same or similar function. The wire or cable could also extend through other elements of the gazebo as long as it performed the same or a similar function. The number of walls which the gazebo has determines the shape of the wire or cable.

Figure 11A:
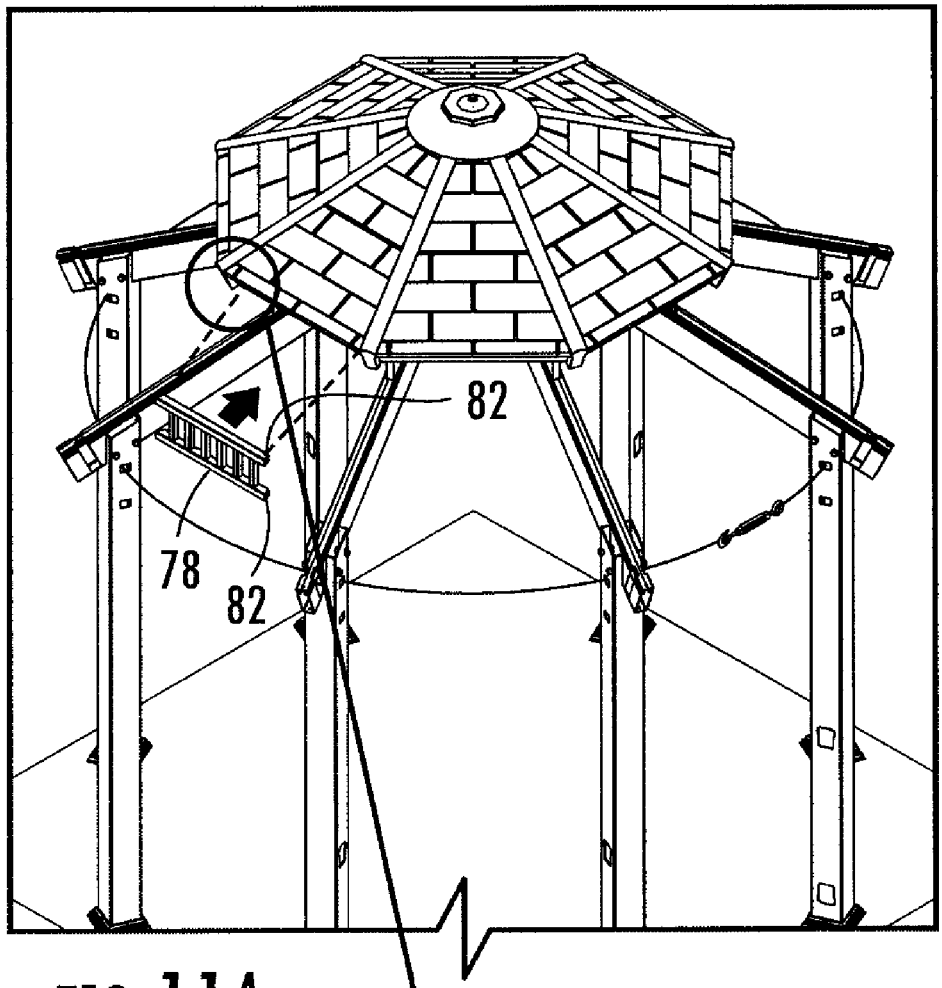
FIG. 11A is a view of an upper roof railing.
Figure 11B:
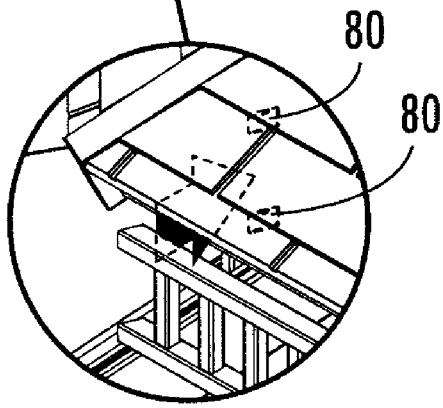
FIG. 11B is a detailed view of an upper roof railing and an upper roof panel.

Referring to FIGS. 11A and 11B upper roof railings 78 are secured in between the outer roof supports 46. In the embodiment illustrated herein there are 8 upper roof railings. The number of upper roof railings preferably corresponds to the number of outer roof supports. As illustrated in FIGS. 4A and 11B each of the outer roof supports 46 has at least two apertures 80. Preferably there are two apertures 80 on a first side of outer roof support 46 and two apertures on a side of outer roof support 46 opposite the first side. The ends 82 of the upper roof railings are placed into apertures 80. The upper roof railings are held in place by the fact that the railings 78 are longer that the distance between the outer roof supports 46. In addition the ends 82 of the upper roof railings can be secured to the outer roof supports 46 by fasteners, friction or other securing means. Preferably the shape of apertures 80 is the same or similar to the cross sectional shape of ends 82.

Figure 12A:
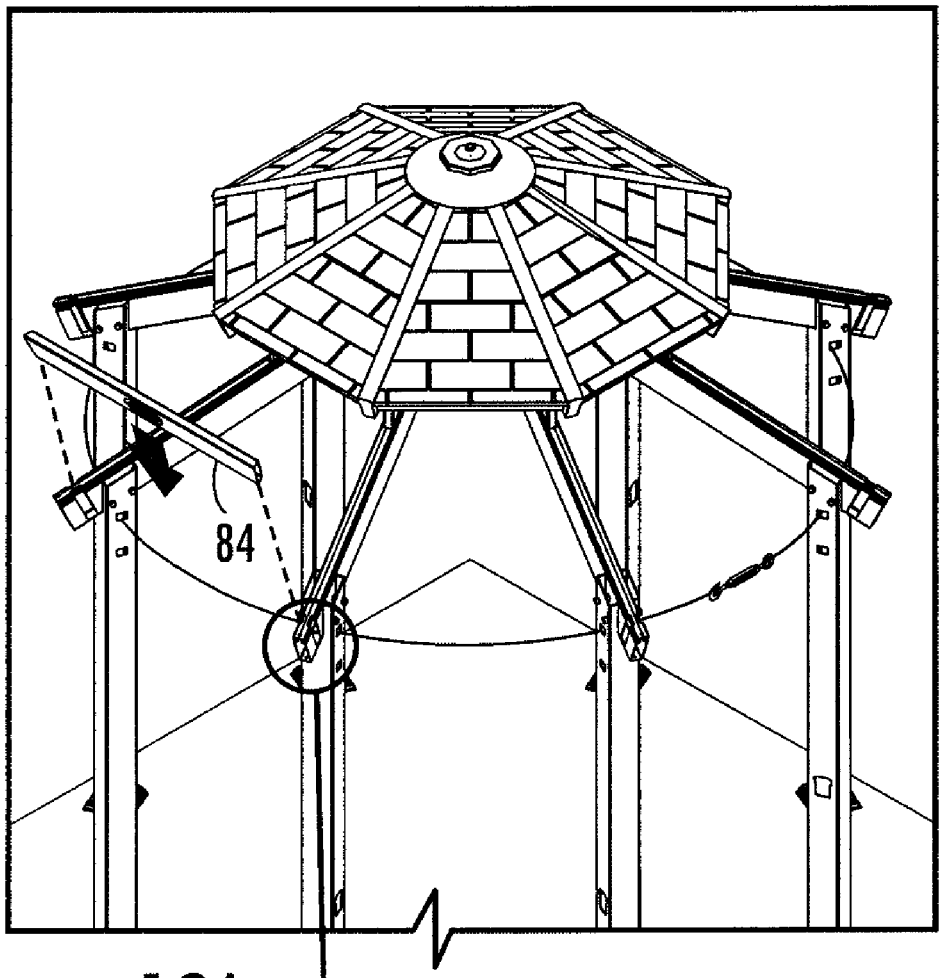
FIG. 12A is a view of a fascia board secured to a lower roof rafter.
Figure 12B:
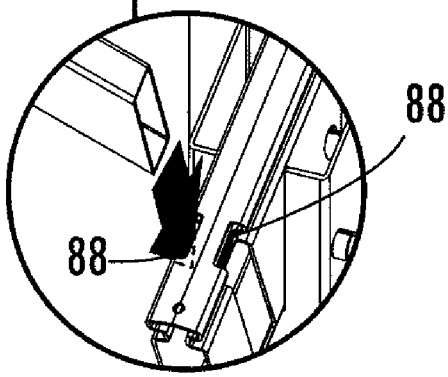
FIG. 12B is a detailed view of a fascia board secured to a lower roof rafter.
Figure 13A:
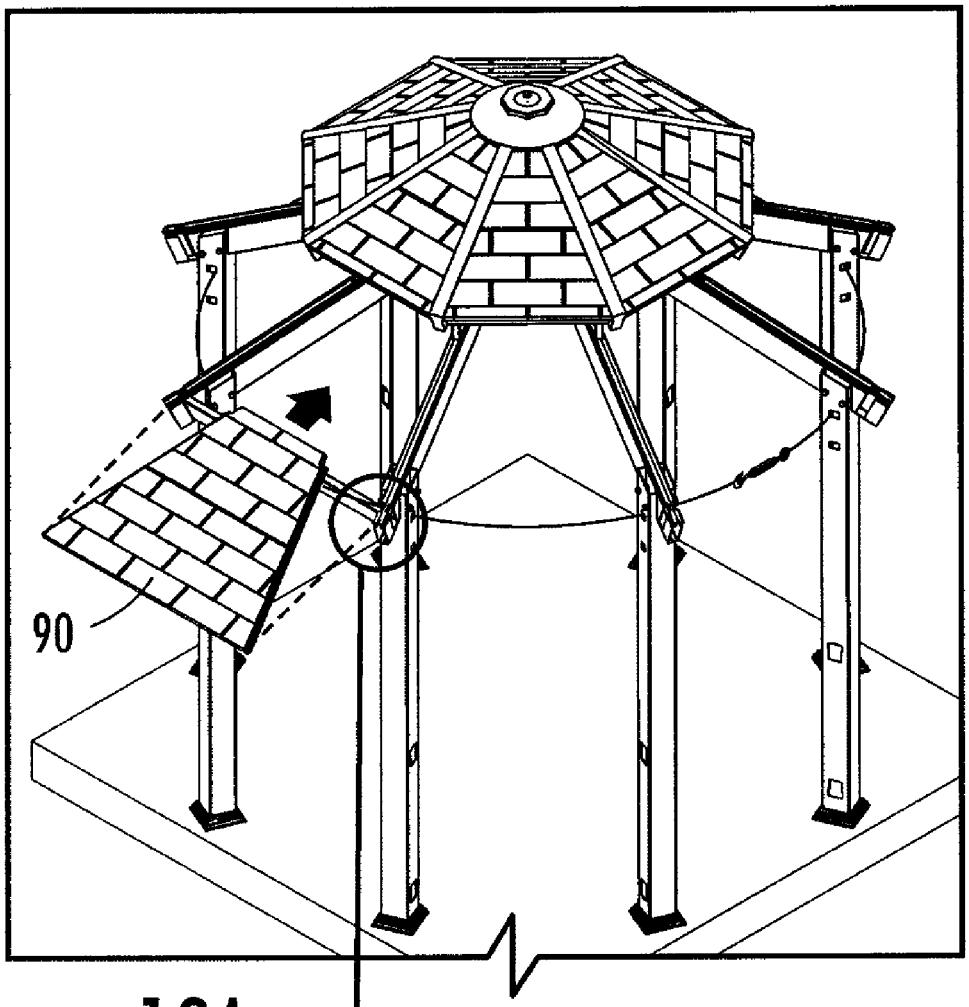
FIG. 13A is a view of the attachment of a lower roof panel to the lower roof rafters.
Figure 13B:
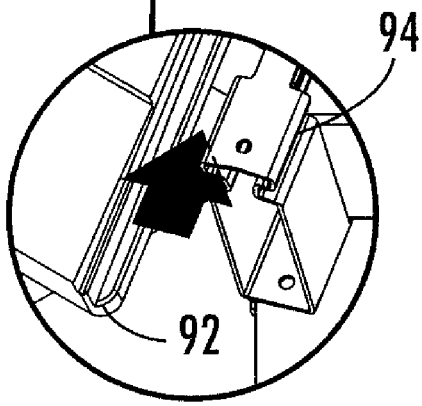
FIG. 13B is a detailed view of the attachment of a lower roof panel to a lower roof rafter.
Figure 14A:
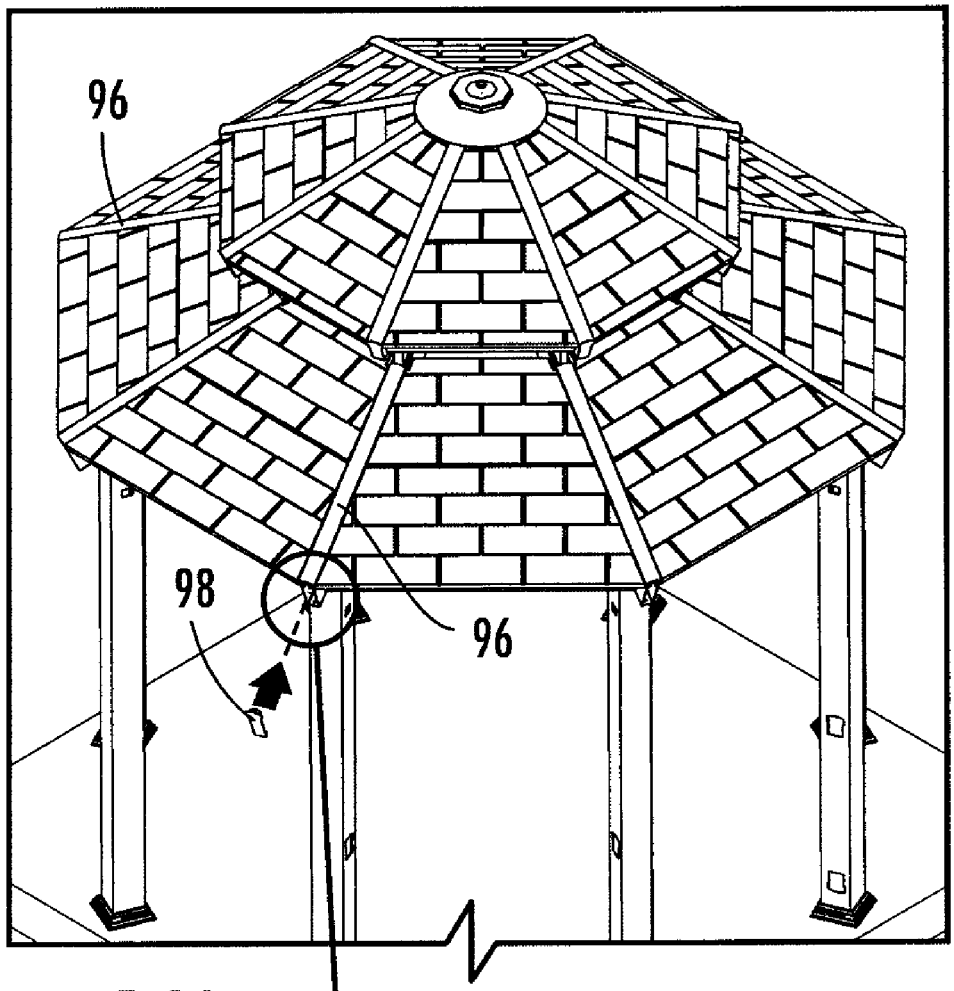
FIG. 14A is a view of all of the lower roof panels secured to the lower roof rafters.
Figure 14B:
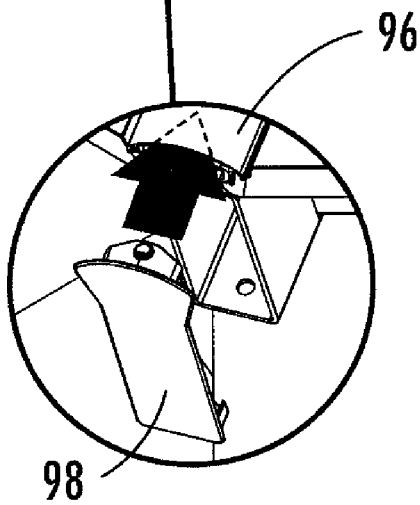
FIG. 14B is a detailed view of an end cap on a lower roof rafter.

Referring to FIGS. 12A and 12B lower roof fascia boards 84 are secured between the outer ends of lower roof rafters 24. The ends of the lower roof fascia boards are placed into slots 88 formed in an outer portion of the lower roof rafters 24, FIG. 12B. In the embodiment illustrated there are 8 fascia boards. The lower roof fascia boards 84 provide stability to the lower roof rafters so that they will maintain a substantially fixed position relative to each other. The lower fascia boards can also be secured to the lower roof rafters 24 by fasteners, friction or other securing means. This positioning of the lower roof rafters enables lower roof panels 90 to be secured between the lower roof rafters. The lower roof panels 90 are provided with a flange 92 (FIG. 13B) which extends along each longitudinal side of the lower roof panel. The flange 92 is designed to be placed into a slot 94 which extends longitudinally along both sides of an upper portion of lower roof rafter 24, FIG. 13B. The lower roof panels 90 are slid up along the lower roof rafters into their final position wherein the narrow portion of the upper roof panel is positioned below the upper roof. Once the roof panels are in their final position they are also secured to the lower roof fascia boards 84 by fasteners or other securing means. Trim elements 96 are secured over the top portion of each of the lower roof raters, as illustrated in FIG. 14A. A cap 98 is placed over each outer open end of each of the lower roof rafters 24 and secured in place as illustrated in FIG. 14B.

Figure 15A:
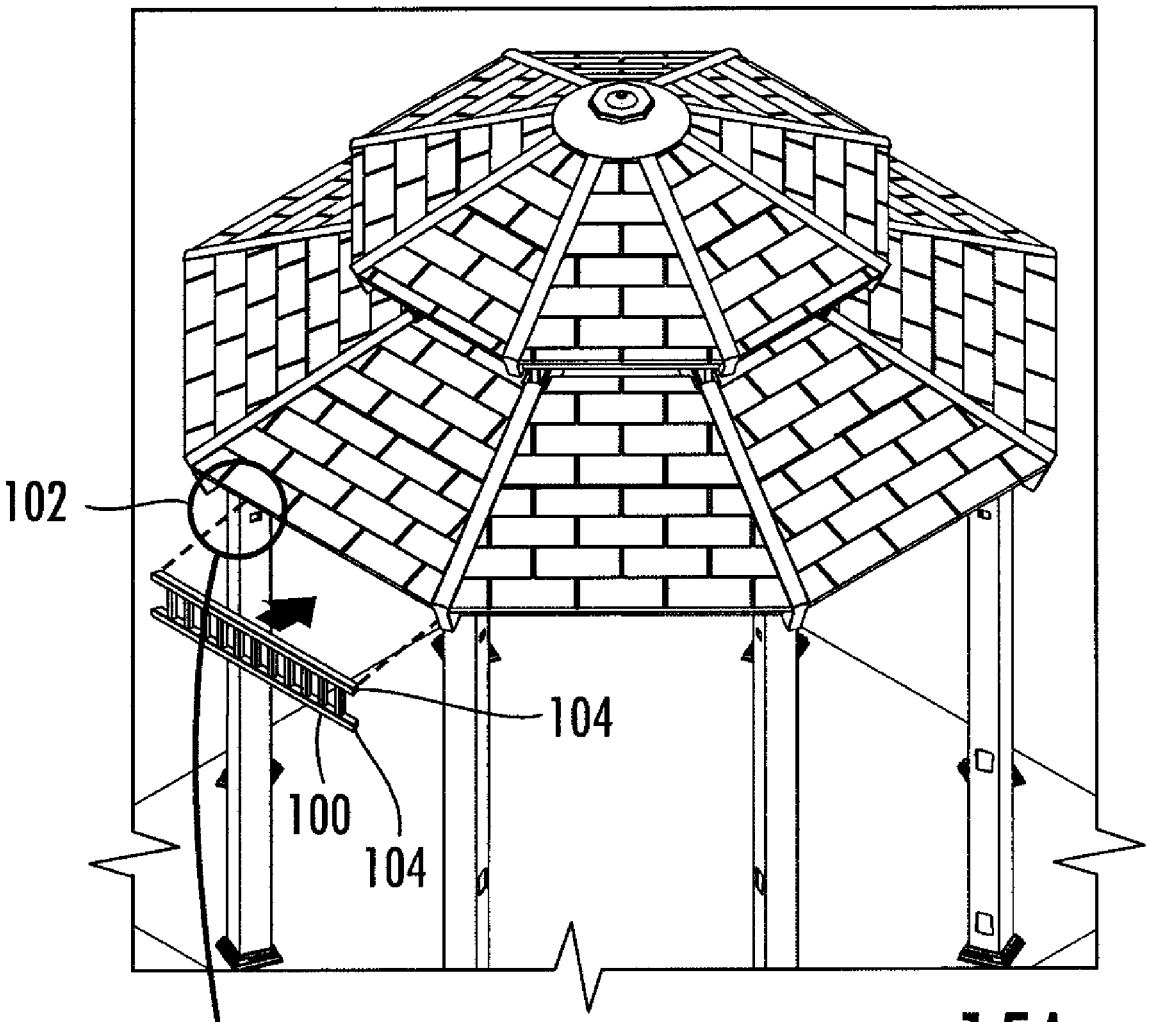
FIG. 15A is a view of a lower roof railing.
Figure 15B:
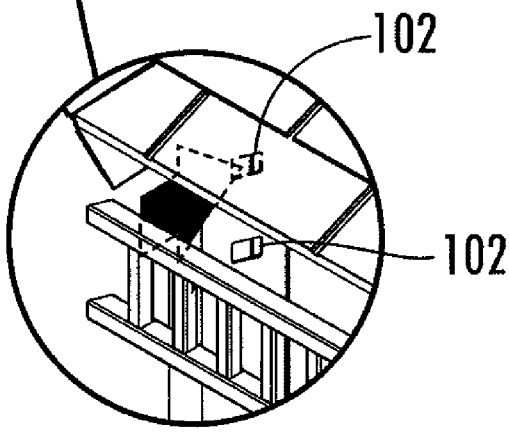
FIG. 15B is a detailed view of a lower roof railing and a lower roof panel.

Referring to FIGS. 15A and 15B lower roof railings 100 are secured in between the support posts 14. In the embodiment illustrated there are 8 lower roof railings. As illustrated in FIG. 15A each of the support posts 14 has at least two apertures 102 in an upper portion. Preferably there are two apertures 102 on a first side of support post 14 and two apertures on a side of post 14 opposite the first side. The ends 104 of the lower roof railings are inserted into these apertures. The lower roof railings are held in place by the fact that the railings 100 are longer that the distance between the support posts 14. In addition the ends 104 of the lower roof railings can be secured to the support posts 14 by fasteners, friction or other securing means. Preferably the shape of apertures 102 is the same or similar to the cross sectional shape of ends 104.

Figure 16A:
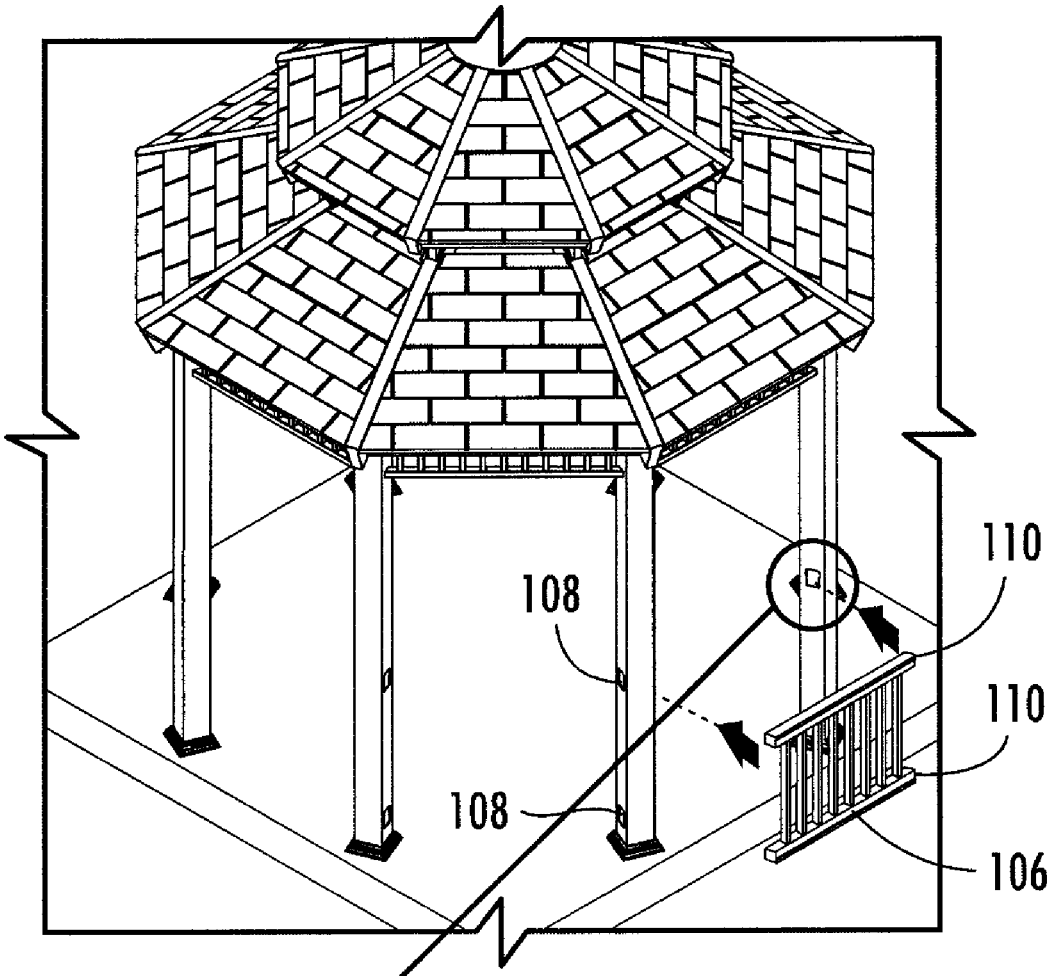
FIG. 16A is a view of hand rails secured to the support posts.
Figure 16B:
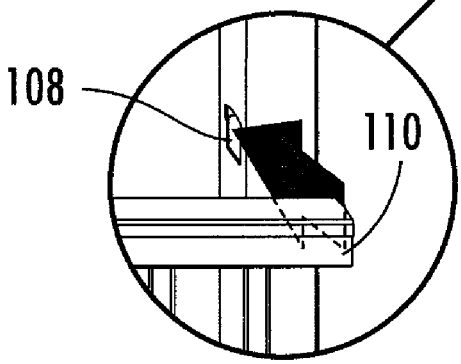
FIG. 16B is a detailed view of the attachment of the hand rails to the support posts.

Referring to FIGS. 16A and 16B hand rails 106 are placed in between support posts 14 at a lower portion of the support posts. Each of the support posts 14 has at least two apertures 108 in a lower portion of the post. Preferably there are two apertures 108 along a first side of support post 14 and two apertures 108 along another side of post 14 opposite the first side. The ends 110 of hand rails 106 are inserted into the apertures 108 thereby securing the hand rails to the support posts 14. The hand railings are held in place by the fact that the railings 106 are longer that the distance between the support posts 14. Preferably the shape of the apertures 108 is the same or similar to the cross sectional shape of the ends 110 of the hand rails. In addition, other means such as fasteners can be employed to secure the handrails to support posts 14. In the embodiment illustrated there are 7 hand rails, see FIG. 1. A hand rail is not secured between support posts 14 wherever an entrance/exit is desired for access to the interior of the gazebo. Although one entrance/exit is shown, there can be a plurality of entrances/exits.

Figure 17A:
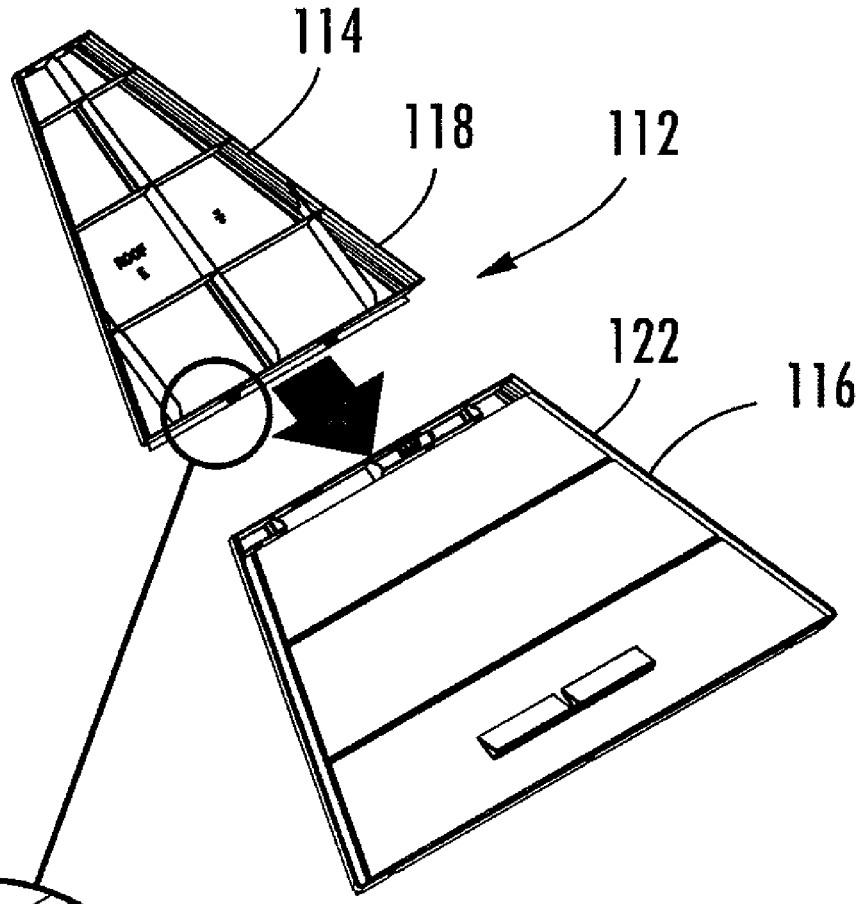
FIG. 17A is an exploded view of an upper roof panel.

Referring to FIGS. 17A-19B the upper roof of the gazebo comprises a plurality of upper roof panels 112. In the embodiment illustrated herein there are 8 upper roof panels. Usually the number of upper roof panels corresponds to the number of sides of the gazebo. However, there could be any number of upper roof panels. In the illustrated embodiment there are 8 sides and 8 upper roof panels. Each of the upper roof panels 112 comprises an upper portion 114 and a lower portion 116. Each upper and lower portion includes a top member and a bottom member. The top member 118 of the upper portion 114 is illustrated in FIGS. 17A, 18A and 19A. The bottom member 120 of the upper portion 114 is illustrated in FIG. 19A. The bottom member 122 of the lower portion 116 is illustrated in FIGS. 17A, 18A and 19A. The top member of the lower portion is not illustrated. The top members of the upper and lower portions of the roof panels have a plurality of roof shingles molded therein. The underside of the top member 120 of the upper portion is illustrated in FIGS. 17A, 18A and 19A. As can be seen in these Figs. a plurality of roof shingles are molded into the member.

Figure 17B:
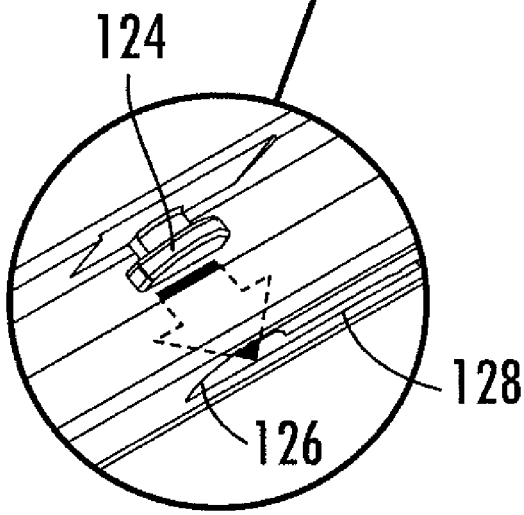
FIG. 17B is a detailed view of the attachment of the upper and lower portions of an upper roof panel.
Figure 18A:
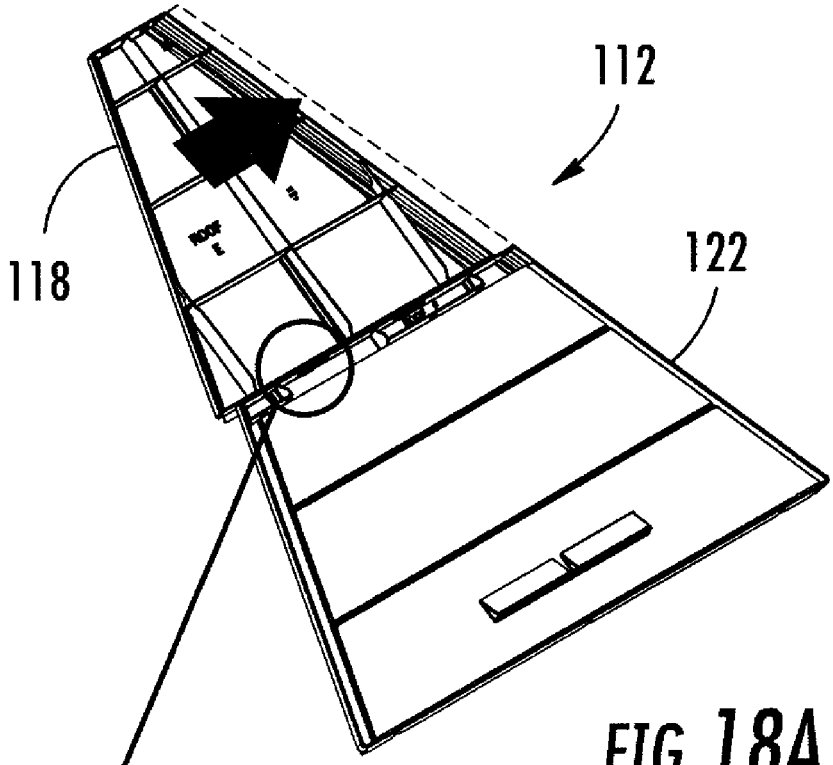
FIG. 18A is an exploded view of an upper roof panel.
Figure 18B:
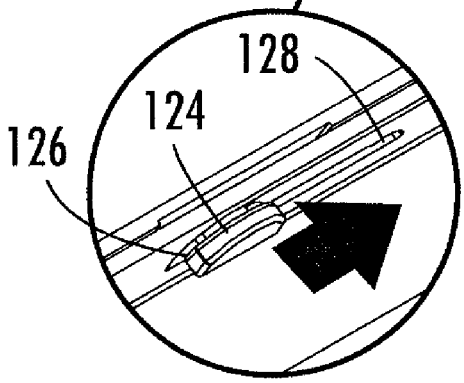
FIG. 18B is a detailed view of the attachment of the upper and lower portions of an upper roof panel.
Figures 19A, 19B:
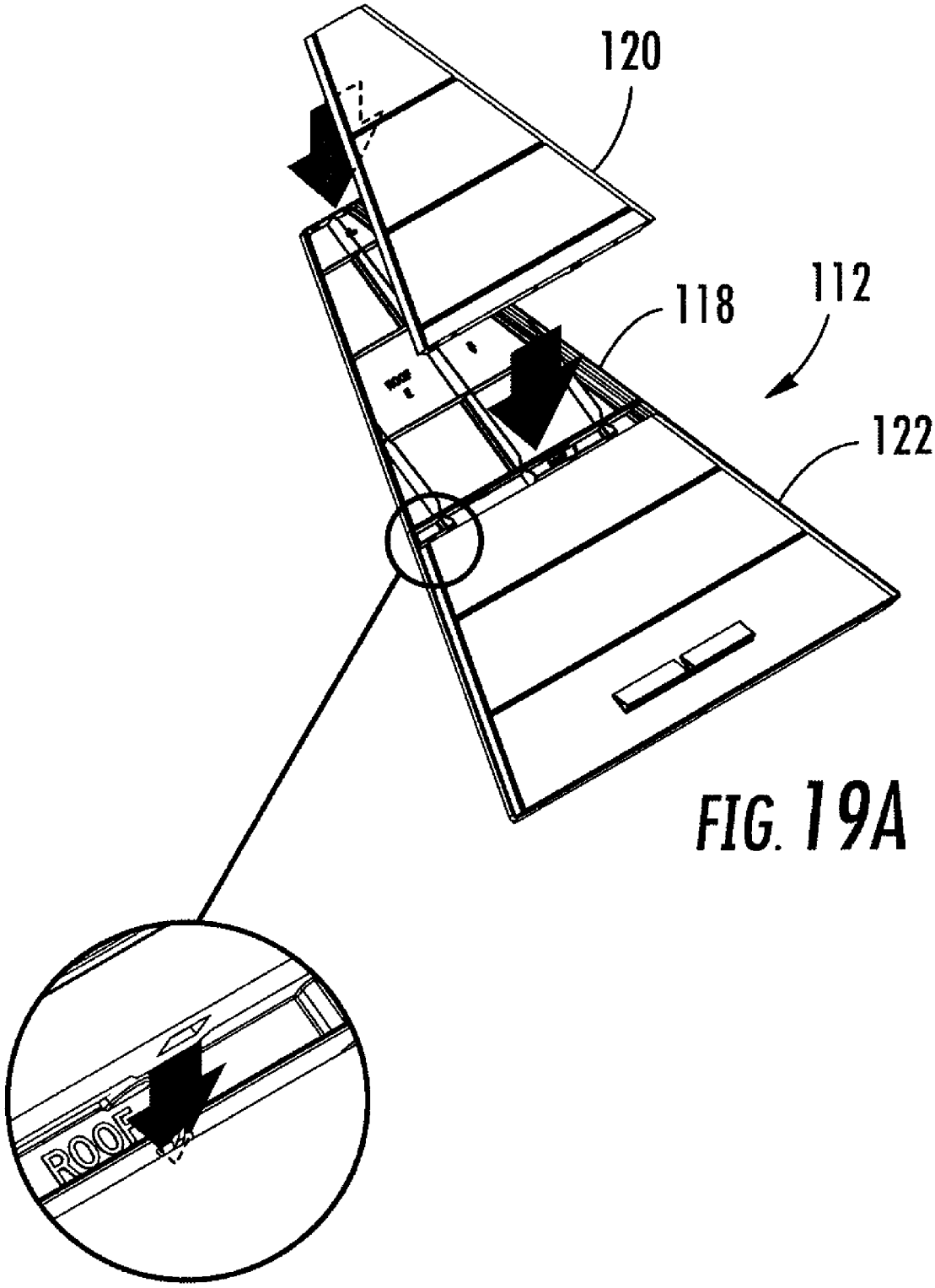
FIG. 19A is an exploded view of an upper roof panel.
FIG. 19B is a detailed view of the attachment of the upper and lower portions of an upper roof panel.

The upper portion 114 of the roof panel 112 is connected to the lower portion 116 of the roof panel utilizing projections 124 formed or molded onto the upper portions of the roof panel. These projections cooperate with apertures 126 and slots 128 formed on the lower portion 116 of the roof panel. In order to connect the upper and lower portions of the roof panels together the projections 124 are placed into slots 126, as illustrated in FIG. 17B. Upper portion 114 is then slid toward the right (FIGS. 17B and 18B) so that projection 124 engages slot 128 to secure the upper and lower portions 114 and 116 together. Of course the locations of the projections, apertures and slots could be reversed so the projections 124 were on the lower portion 116 and the apertures 126 and slots 128 were on the upper portion 114.

Figure 20A:
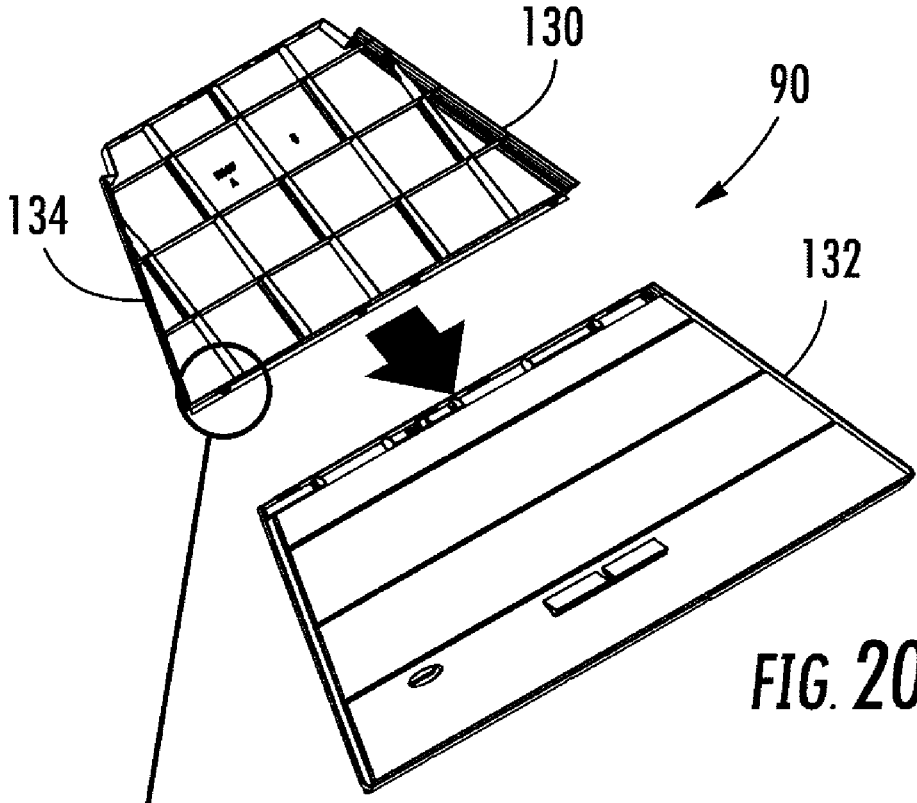
FIG. 20A is an exploded view of a lower roof panel.
Figure 20B:
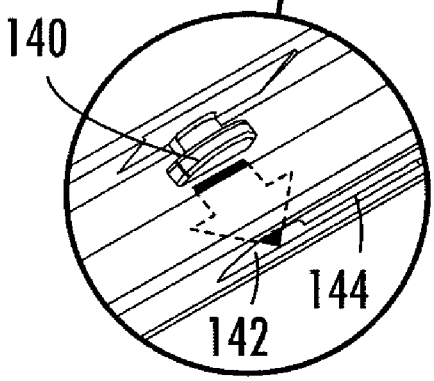
FIG. 20B is a detailed view of the attachment of the upper and lower portions of a lower roof panel.

Referring to FIGS. 20A-22B the lower roof of the gazebo comprises a plurality of lower roof panels 90. In the embodiment illustrated herein there are 8 lower roof panels. Usually the number of lower roof panels corresponds to the number of sides of the gazebo. However, there could be any number of lower roof panels. In the illustrated embodiment there are 8 sides and 8 lower roof panels. Each of the lower roof panels 90 comprises an upper portion 130 and a lower portion 132. Each upper and lower portion includes a top member and a bottom member. The top member 134 of the upper portion 130 is illustrated in FIGS. 20A, 21A and 22A. The bottom member 136 of the upper portion 130 is illustrated in FIG. 22A. The bottom member 138 of the lower portion 132 is illustrated in FIGS. 20A, 21A and 22A. The top member of the lower portion is not illustrated. The top members of the upper and lower portions of the roof panels have a plurality of roof shingles molded therein. The underside of the top member 134 of the upper portion is illustrated in FIGS. 20A, 21A and 22A. As can be seen in these figures a plurality of roof shingles are molded into the member 134.

Figures 21A, 21B:
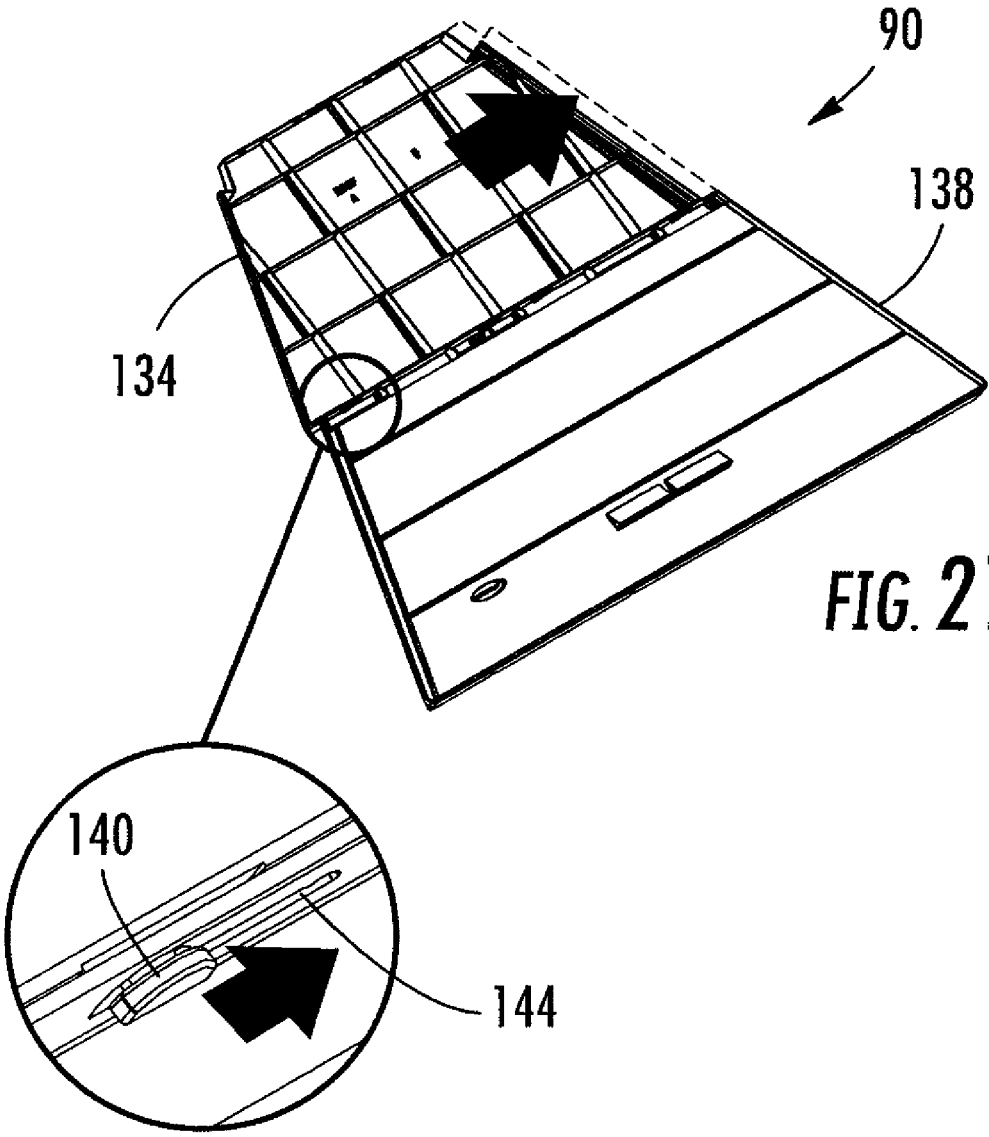
FIG. 21A is an exploded view of a lower roof panel.
FIG. 21B is a detailed view of the attachment of the upper and lower portions of a lower roof panel.
Figure 22A:
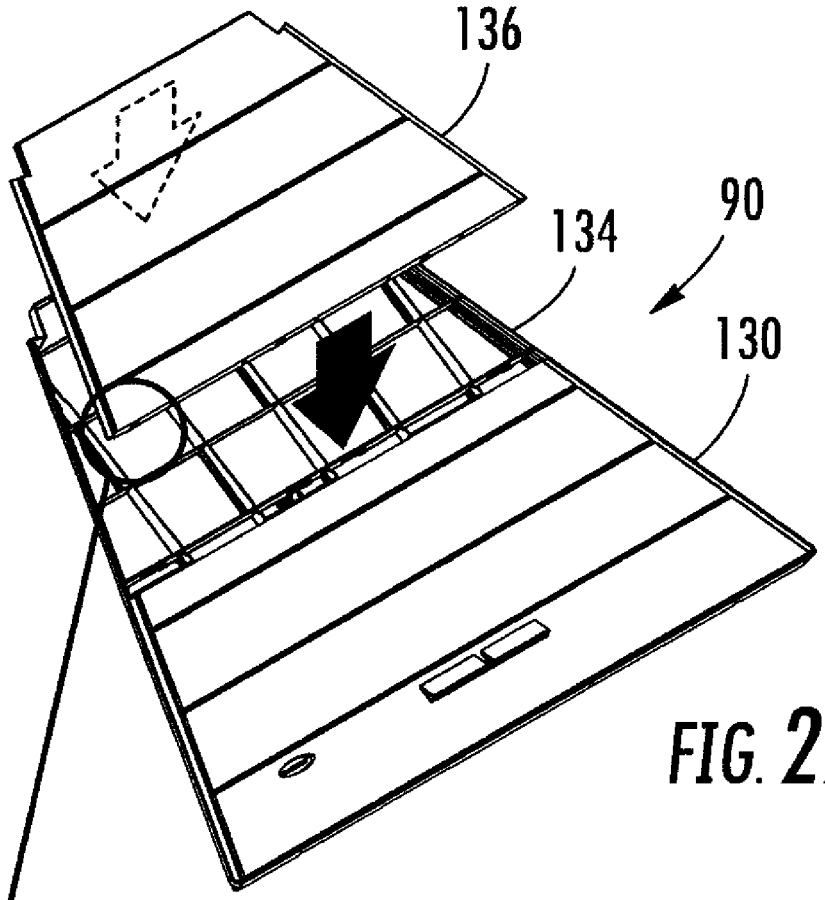
FIG. 22A is an exploded view of a lower roof panel.
Figure 22B:
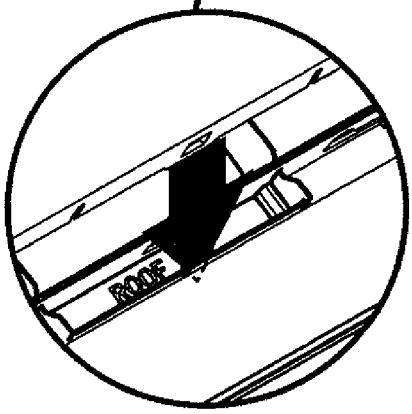
FIG. 22B is a detailed view of the attachment of the upper and lower portions of a lower roof panel.

The upper portion 130 of the roof panel 90 is connected to the lower portion 132 of the roof panel utilizing projections 140 formed or molded onto the upper portions of the roof panel. These projections cooperate with apertures 142 and slots 144 formed on the lower portion 132 of the roof panel. In order to connect the upper and lower portions of the roof panels together the projections 140 are placed into slots 144, as illustrated in FIG. 21B. Upper portion 130 is then slid toward the right (FIGS. 20B and 21B) so that projection 140 engages slot 144 to secure the upper and lower portions 130 and 132 together. Of course the locations of the projections, apertures and slots could be reversed so the projections 140 were on the lower portion 132 and the apertures 142 and slots 144 were on the upper portion 130.

Figure 23:
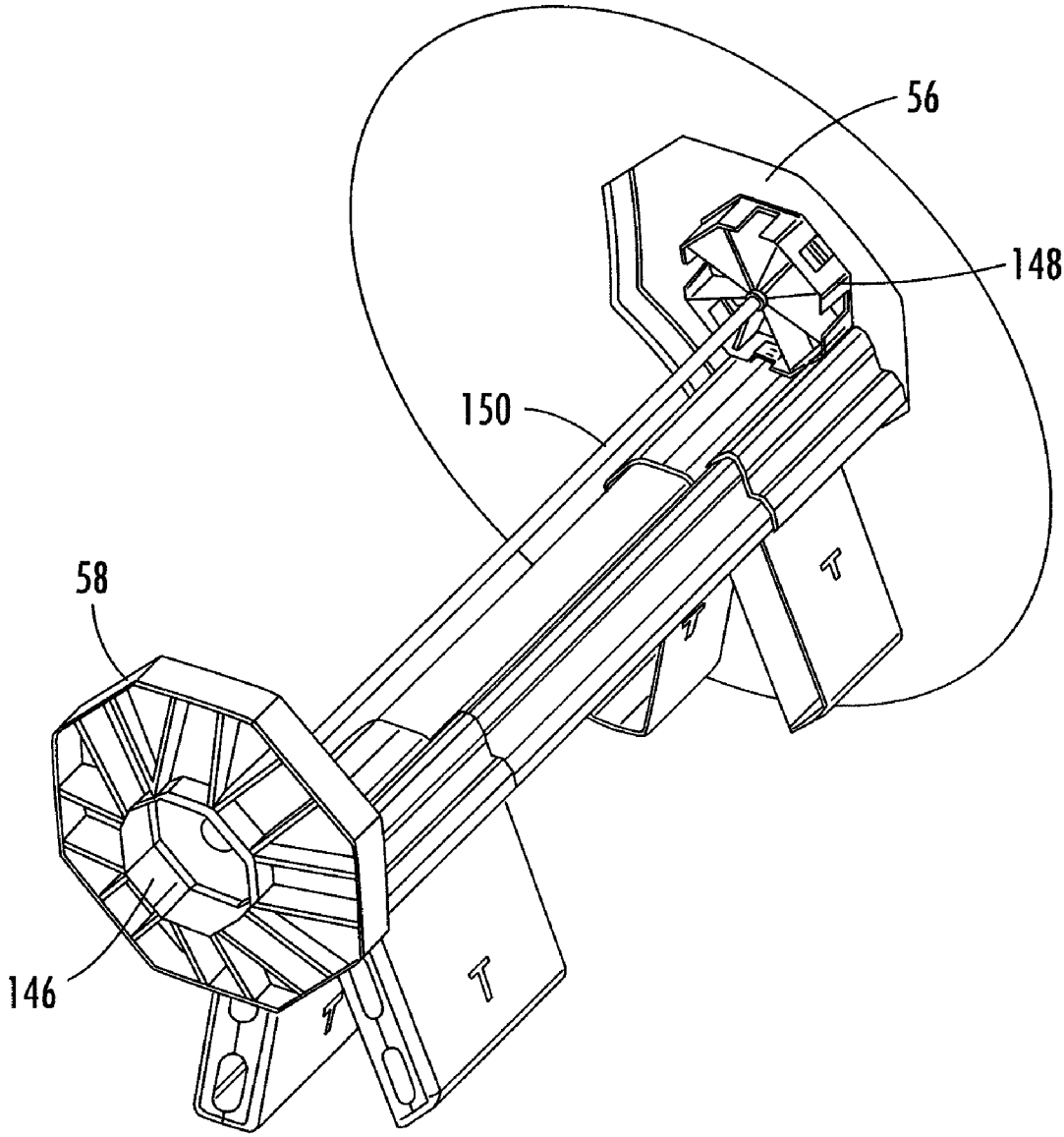
FIG. 23 is a perspective of an optional provision for attaching a fan to the interior of the gazebo of the present invention.

A fan can optionally be installed in the gazebo 10. The fan, not shown could be secured to a box 146 constructed and arranged to support the fan and provide electrical power to the fan, as illustrated in FIG. 23. Box 146 is secure to cap 58 which in turn is secured to the bottom portions of receptacles 30 and holds the receptacles 30 together, as illustrated in FIG. 7A. Another box 148 is secured to another cap 56. Cap 56 secures a plurality of receptacles 38 together, as illustrated in FIG. 8A. A rod or similar member 150 is secured to box 146 and box 148. This provides and optional structure to help secure the upper, middle and lower sections of the center hub together. Electrical power is supplied to the fan by wires or other electrical transmitting devices which are connected to a source of electrical power. The wires are next run to an up the support posts 14, through the lower roof rafters 24 and into the electrical box 146. Other paths for the electrical wires are also possible. The different paths would be determined by the structure of the gazebo, the needs of the builder, aesthetic appearances, building codes, etc.

Figure 24:
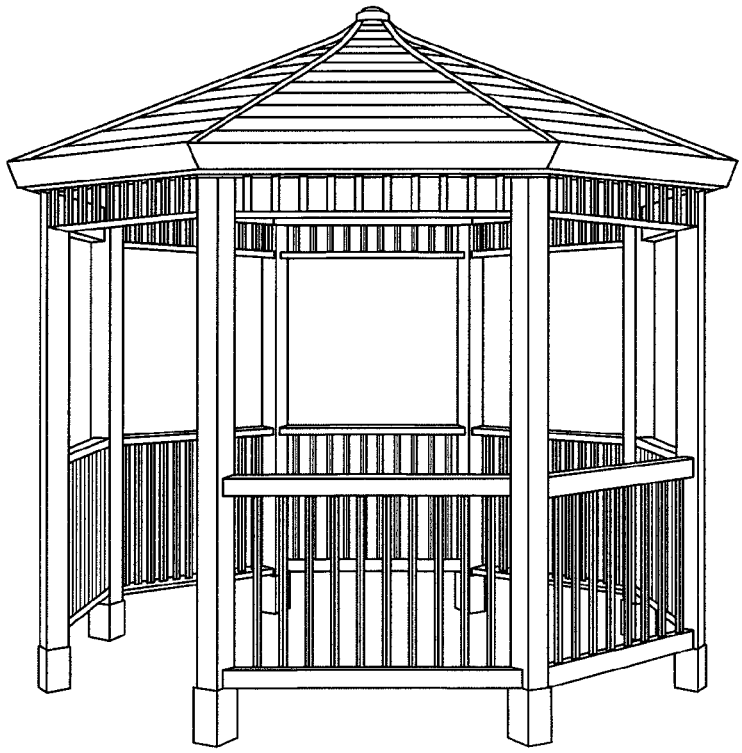
FIG. 24 is another embodiment of the gazebo of the present invention.

Another embodiment of the gazebo is illustrated in FIG. 24. In this embodiment the gazebo has a single roof in place of the upper and lower roofs.

Figure 25:
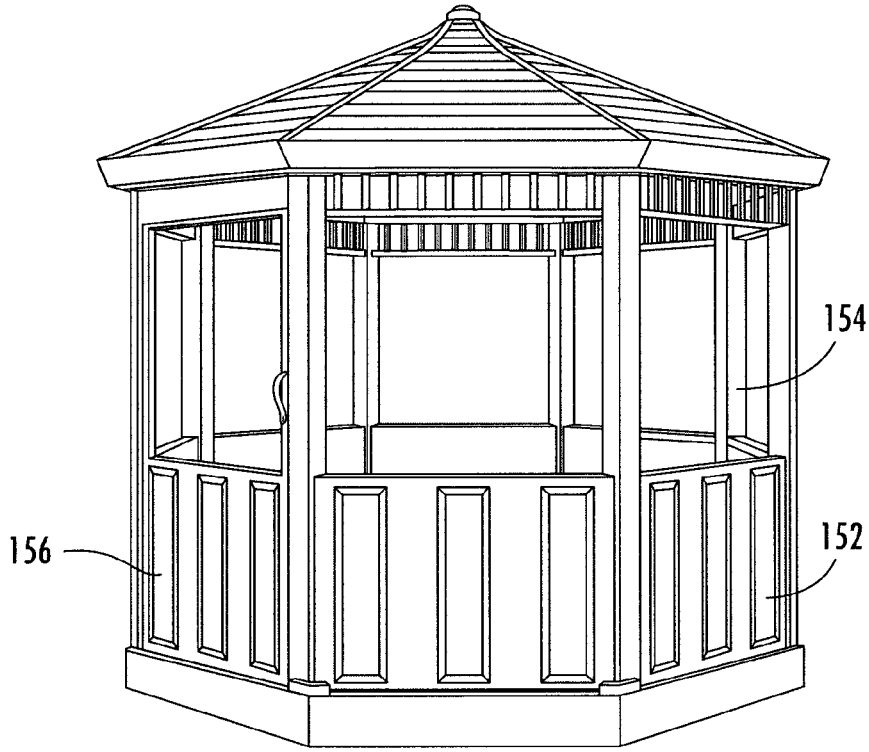
FIG. 25 is another embodiment of the gazebo of the present invention.

A further embodiment of the gazebo is illustrated in FIG. 25. In this embodiment the side portions of the gazebo include partial side walls 152, screens 154 and a door 156.

Figure 26:
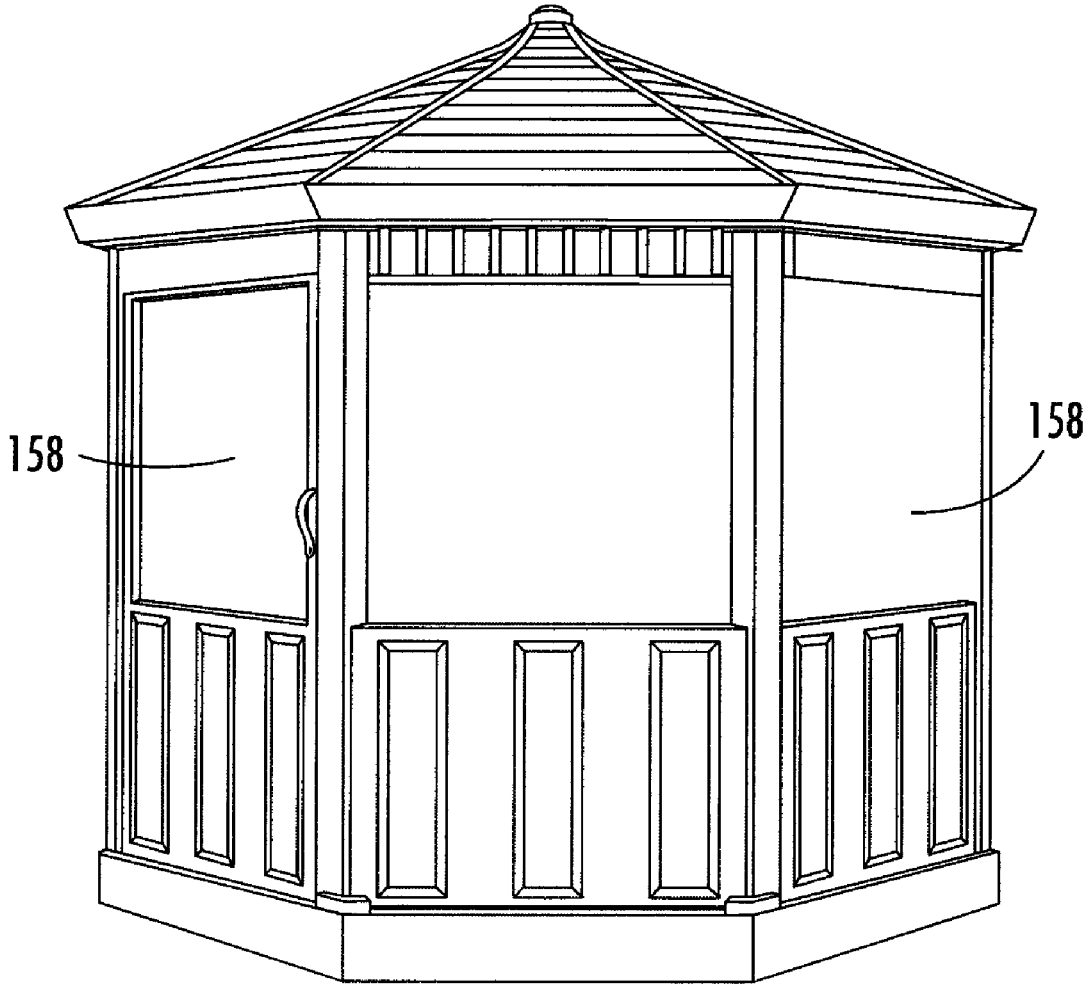
FIG. 26 is another embodiment of the gazebo of the present invention.

A still further embodiment of the gazebo is illustrated in FIG. 26. In this embodiment solid molded panels or a plastic sheet 158 can be placed over the screens 154 to enable the gazebo to be utilized in the winter and to protect items within the gazebo from the elements of the weather.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A plastic roof assembly for enclosing a structure comprising:

a center hub comprising a upper section, a middle section and a lower section, each section including a plurality of vertically extending segments, said segments being substantially polygonal in cross section, said plurality of segments being constructed and arranged for juxtaposed arrangement to form said center hub;

each said segment of said upper section including connection members for attachment to an upper rafter;

each said segment of said middle section being constructed and arranged to extend between one of said upper section segments and one of said lower section segments; and each segment of said lower section including connection members for attachment to a lower rafter, said connection members including a plurality of ramp locks located on one of said vertically extending segments or said rafters, a plurality of apertures located on one of said rafters or said vertical segments, said apertures constructed and arranged to receive said ramp locks forming a connection between said vertical segments and said rafters.

2. The plastic roof assembly of claim 1 including roof panels secured between said rafters, wherein a plurality of said roof panels are secured to said rafters adjacent each other in a circumferential array to form a roof assembly.

3. The plastic roof assembly of claim 1, including an end cap constructed and arranged to receive and retain said vertical segments in juxtaposed arrangement to form said central hub and wherein said end cap is located on at least one end of said central hub.

4. The plastic roof assembly of claim 2 wherein said roof panels include an upper portion and a lower portion, said upper portion includes the top surface of said roof panel; said lower portion includes the bottom surface of said roof panel.

5. The plastic roof assembly of claim 4 wherein said upper portion includes a surface design which is different from a surface design on said lower portion.

6. The plastic roof assembly of claim 1 including a rafter support post connected to said upper rafter and said lower rafter;

said rafter support post supporting said upper rafter above and spaced from said lower rafter.

7. The plastic roof assembly of claim 2 including a panel member secured between each said upper rafters; said panel secured to said upper rafter adjacent a second end thereof.

8. The plastic roof assembly of claim 2 including a groove on both sides of said upper rafters and said lower rafters; said grooves extending substantially along the length of said upper rafters and said lower rafters; edges of said roof panels engaging said grooves securing said roof panels between at least two said upper rafters and between at least two said lower rafters.

9. The plastic roof assembly of claim 1 wherein said upper rafters and said lower rafters are hollow and an end cap secured to and closing an end of each said upper and each said lower rafters.

10. The plastic roof assembly of claim 1 including a panel member secured between each said lower rafters; said panel secured to said lower rafter adjacent a second end thereof.

11. The plastic roof assembly of claim 6 including a rail member connected to and secured between at least two rafter support posts.

12. A gazebo comprising a plastic roof assembly which includes:

a center hub including a upper section, a middle section and a lower section, each section including a plurality of vertically extending segments, said segments being substantially polygonal in cross section, said plurality of segments being constructed and arranged for juxtaposed arrangement to form said center hub;

each said segment of said upper section including connection members for attachment to a first end of an upper rafter;

each said segment of said middle section being constructed and arranged to extend between one of said upper section segments and one of said lower section segments;

each segment of said lower section including connection members for attachment to a first end of a lower rafter, said connection members include a plurality of ramp locks located on one of said vertically extending segments or said rafters, a plurality of apertures located on one of said rafters or said vertical segments, said apertures constructed and arranged to receive said ramp locks forming a connection between said vertical segments and said rafters; and a plurality of substantially vertical columns, wherein an upper portion of said columns is secured proximate a second end of said lower rafters.

13. The gazebo of claim 12 including a first rail member connected to and secured between at least two columns.

14. The gazebo of claim 13 including a second rail member connected to and secured between at least two columns; said first rail member secured to said column adjacent an upper portion of said column and said second rail member secured to said column adjacent a lower portion of said column.

15. The gazebo of claim 12 including roof panels secured between said rafters, wherein a plurality of said roof panels are secured to said rafters adjacent each other in a circumferential array to form a roof assembly.

16. The gazebo of claim 15 including a groove on both sides of said upper rafters and said lower rafters; said grooves extending substantially along the length of said upper rafters and said lower rafters; edges of said roof panels engaging said grooves securing said roof panels between at least two said upper rafters and between at least two said lower rafters.

17. The gazebo of claim 12 wherein said upper rafters and said lower rafters are hollow and an end cap secured to and closing a second end of each said upper and each said lower rafters.

18. The gazebo of claim 12 including a panel member secured between each said lower rafters; said panel secured to said lower rafter adjacent a second end thereof.

* * * * *